US010549558B2

(12) United States Patent
Masuda et al.

(10) Patent No.: US 10,549,558 B2
(45) Date of Patent: Feb. 4, 2020

(54) CUTTING APPARATUS AND PRINTING APPARATUS

(71) Applicant: CANON KABUSHIKI KAISHA, Tokyo (JP)

(72) Inventors: Shuichi Masuda, Yokohama (JP); Naoki Wakayama, Kawasaki (JP); Masakazu Nagashima, Yokohama (JP); Daiki Anayama, Yokohama (JP); Tetsuo Kikuchi, Ayase (JP); Takakazu Ohashi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 28 days.

(21) Appl. No.: 15/272,718

(22) Filed: Sep. 22, 2016

(65) Prior Publication Data

US 2017/0087890 A1 Mar. 30, 2017

(30) Foreign Application Priority Data

Sep. 28, 2015 (JP) ..... 2015-190049
Sep. 28, 2015 (JP) ..... 2015-190118
Sep. 28, 2015 (JP) ..... 2015-190175

(51) Int. Cl.
*B41J 11/70* (2006.01)
*B26D 1/18* (2006.01)
*B26D 5/08* (2006.01)

(52) U.S. Cl.
CPC ..... *B41J 11/70* (2013.01); *B26D 1/185* (2013.01); *B26D 5/08* (2013.01)

(58) Field of Classification Search
CPC .. B41J 11/66; B41J 11/68; B41J 11/70; B26D 1/18; B26D 1/185; Y10T 83/8821; Y10T 83/8822
(Continued)

(56) References Cited

U.S. PATENT DOCUMENTS 4,544,293 A * 10/1985 Cranston ..... B41J 11/70 400/320
4,726,697 A * 2/1988 Maedge ..... B41J 11/70 271/3.01
(Continued)

FOREIGN PATENT DOCUMENTS

JP H06-015535 A 1/1994
JP H08-138787 A 5/1996
(Continued)

OTHER PUBLICATIONS

Japanese Office Action issued in corresponding Japanese Application No. 2015/190118, dated Jun. 25, 2019.

*Primary Examiner* — Andrea L Wellington
*Assistant Examiner* — Richard D Crosby, Jr.
(74) *Attorney, Agent, or Firm* — Venable LLP

(57) ABSTRACT

A cutter unit is attached to a carriage in a predetermined direction, the carriage moving in a cutting direction of a sheet. A first set of first fitting sections and a second set of second fitting sections are provided as groups of fitting sections provided at positions, which face each other, on the carriage and the cutter unit. The first fitting sections and the second fitting sections each of which are fitted to each other in a predetermined direction. When the cutter unit is attached to the carriage, the fitting of the first fitting sections starts before the fitting of the second fitting sections.

13 Claims, 16 Drawing Sheets

(58) Field of Classification Search
USPC ..... 83/613, 614
See application file for complete search history.

(56) References Cited

U.S. PATENT DOCUMENTS 4,829,641 A * 5/1989 Williams ..... B65D 33/2541 24/399
5,136,308 A * 8/1992 Saito ..... B41J 23/025 346/104
5,356,222 A * 10/1994 Kettner ..... B65D 33/2541 24/DIG. 50
5,746,527 A * 5/1998 Nebashi ..... B26D 1/085 101/93.07
5,881,624 A * 3/1999 Brugue ..... B26D 1/185 30/265
6,341,548 B1 * 1/2002 Hirahata ..... B26F 1/3813 83/699.41
6,721,060 B1 * 4/2004 Kawamura ..... B26D 1/245 358/1.3
6,749,352 B2 * 6/2004 Yamada ..... B26D 7/22 101/226
6,773,180 B2 * 8/2004 Tsuji ..... B41J 11/007 400/605
6,916,132 B2 * 7/2005 Otsuka ..... B41J 3/60 400/188
6,923,534 B2 * 8/2005 Sai ..... B26D 7/088 101/416.1
7,815,382 B2 * 10/2010 Monclus ..... B26D 1/0006 400/621
8,500,350 B2 * 8/2013 Kumai ..... B26D 1/245 400/619
8,767,224 B2 * 7/2014 Tsuji ..... B41J 11/70 358/1.1
8,777,502 B2 * 7/2014 Shirotori ..... B41J 11/70 400/621
8,840,330 B2 * 9/2014 Shirotori ..... B26D 1/305 271/171
8,882,240 B2 * 11/2014 Hirosawa ..... B41J 2/1652 347/19
8,911,168 B2 * 12/2014 Yoshinuma ..... B26D 1/185 400/621
9,545,733 B2 * 1/2017 Maruyama ..... B26D 1/245
10,124,609 B2 * 11/2018 Kikuchi ..... B41J 2/01
2001/0039866 A1 * 11/2001 Kohda ..... B26D 1/205 83/487
2008/0317545 A1 12/2008 Hirose et al.
2009/0226236 A1 * 9/2009 Yamashita ..... B26D 1/185 400/621
2010/0045724 A1 * 2/2010 Toki ..... B41J 23/025 347/16
2012/0222531 A1 * 9/2012 Ogawa ..... B65H 35/04 83/401
2012/0222532 A1 * 9/2012 Yamada ..... B65H 35/04 83/401
2012/0253504 A1 * 10/2012 Kawaguchi ..... B26D 5/005 700/187
2013/0192439 A1 * 8/2013 Endo ..... B26D 1/245 83/425.2
2014/0152752 A1 * 6/2014 Hoshino ..... B41J 11/70 347/104
2014/0178117 A1 * 6/2014 Takei ..... B41J 11/70 400/621
2014/0253655 A1 * 9/2014 Sai ..... B41J 11/007 347/104
2014/0352559 A1 * 12/2014 Matsushima ..... B26D 5/005 101/3.1
2015/0251866 A1 * 9/2015 Shimizu ..... B65H 3/0684 271/228
2016/0067874 A1 3/2016 Maruyama et al.
2016/0067987 A1 * 3/2016 Ohashi ..... B26D 1/245 347/104
2016/0067988 A1 * 3/2016 Anayama ..... B26D 1/245 347/104
2016/0068362 A1 * 3/2016 Oyane ..... B65H 35/008 83/107
2016/0144525 A1 * 5/2016 Kenmotsu ..... B65H 35/02 83/74
2017/0087889 A1 * 3/2017 Kikuchi ..... B41J 2/01

FOREIGN PATENT DOCUMENTS

JP 2008-030168 A 2/2008
JP 2009-002466 A 1/2009
JP 2013-154444 A 8/2013

* cited by examiner

CUTTING APPARATUS AND PRINTING APPARATUS

BACKGROUND OF THE INVENTION

Field of the Invention

The present invention relates to a cutting apparatus that can cut a sheet and a printing apparatus including the cutting apparatus.

Description of the Related Art

Japanese Patent Laid-Open No. 2008-30168 discloses a cutting apparatus in which a cutter unit including a rotary blade can be attached to and detached from a carriage moving in a cutting direction of a sheet, and a user can replace the rotary blade with a new rotary blade by replacing the cutter unit. The cutting apparatus is adapted so that a cutter unit-side input rotating shaft, which has a hexagonal cross-section and is connected to the rotary blade, is fitted to a hole, which has a hexagonal cross-section and is formed in a carriage-side output rotating shaft, when the cutter unit is attached to the carriage. The output rotating shaft and the input rotating shaft form a transmission mechanism that transmits a driving force used to rotate the rotary blade.

However, when the cutter unit is attached to the carriage, it is difficult to correctly position the cutter unit by only the fitting of the output rotating shaft and the input rotating shaft that form the transmission mechanism for transmitting the driving force.

Moreover, since the output rotating shaft and the input rotating shaft are provided at fixed positions on corresponding the carriage and the cutter unit, it is difficult for a user to accurately position the output rotating shaft and the input rotating shaft and to quickly fit these rotating shafts to each other. For this reason, the cutter unit could not be efficiently attached.

SUMMARY OF THE INVENTION

The present invention provides a cutting apparatus in which a cutter unit can be attached to a carriage with high work efficiency, and a printing apparatus.

Further, the present invention provides a cutting apparatus in which positioning accuracy of a cutter unit is improved while size of an apparatus is reduced and the cutter unit can be attached to a carriage with high work efficiency, and a printing apparatus.

Furthermore, the present invention provides a cutting apparatus in which a cutter unit can be efficiently attached to a carriage, and a printing apparatus.

In the first aspect of the present invention, there is provided a cutting apparatus comprising:

a carriage configured to move in a cutting direction of a sheet; and a cutter unit including a blade, wherein the cutter unit is attached to the carriage by a first set of first fitting sections and a second set of second fitting sections each of which are fitted to each other, and when the cutter unit is attached to the carriage, the fitting of the first fitting sections starts before the fitting of the second fitting sections.

In the second aspect of the present invention, there is provided a cutting apparatus comprising:

a carriage configured to move in a cutting direction of a sheet;

a cutter unit including a rotary blade; and a transmission mechanism configured to transmit rotation of an output portion of the carriage to the rotary blade through an input portion of the cutter unit, wherein one of the carriage and the cutter unit is provided with a positioning protruding portion, the other thereof is provided with a positioning recessed portion to which the positioning protruding portion is fitted, and the cutter unit is attached to the carriage by fitting the positioning protruding portion and the positioning recessed portion to each other, and the output portion, the input portion, the positioning protruding portion, and the positioning recessed portion are disposed at positions on the same axis extending in a direction in which the cutter unit is attached to the carriage.

In the third aspect of the present invention, there is provided a cutting apparatus comprising:

a carriage configured to move in a cutting direction of a sheet; and a cutter unit including a blade, wherein one of the carriage and the cutter unit is provided with a protruding portion, the other thereof is provided with a recessed portion to which the protruding portion is fitted in a predetermined direction, and the cutter unit is attached to the carriage by fitting of the protruding portion and the recessed portion to each other, and while the cutter unit is attached to the carriage, one of the protruding portion and the recessed portion is displaceable in a direction crossing the predetermined direction.

In the fourth aspect of the present invention, there is provided a cutting apparatus comprising:

a carriage configured to move in a cutting direction of a sheet; and a cutter unit including a blade, wherein one of the carriage and the cutter unit is provided with a protruding portion, the other thereof is provided with a recessed portion to which the protruding portion is fitted, and the cutter unit is attached to the carriage by fitting the protruding portion and the recessed portion to each other, and the protruding portion and the recessed portion have the same color, and the color is different from colors of other peripheral portions.

In the fifth aspect of the present invention, there is provided a printing apparatus comprising:

a printing unit configured to print an image on a sheet; and a cutting apparatus according to the first aspect of the present invention that cuts the sheet used in the printing unit.

According to the present invention, since the first set of the first fitting sections and the second set of the second fitting sections are fitted at shifted timings when the cutter unit is attached to the carriage, the cutter unit can be positioned with high work efficiency.

Further, according to the present invention, since the structure of a mechanism for positioning the cutter unit is provided so as to be concentrated on a portion forming a transmission mechanism for transmitting power to a rotary blade by the attaching of the cutter unit to the carriage, the positioning accuracy of the cutter unit can be improved while the size of the apparatus is reduced. As a result, the cutter unit can be attached to the carriage with high work efficiency.

Furthermore, according to the present invention, since one of the protruding portion and the recessed portion of the fitting sections of the carriage and the cutter unit is displaceable, the protruding portion and the recessed portion can be fitted to each other after the protruding portion and the recessed portion are roughly positioned by using the displacement of one of the protruding portion and the recessed portion. As a result, a user can quickly understand a positional relationship between the protruding portion and the recessed portion and can efficiently attached the cutter unit to the carriage.

Further features of the present invention will become apparent from the following description of exemplary embodiments (with reference to the attached drawings).

DESCRIPTION OF THE EMBODIMENTS

Embodiments of the invention will be described below with reference to the drawings.

Figure 1:
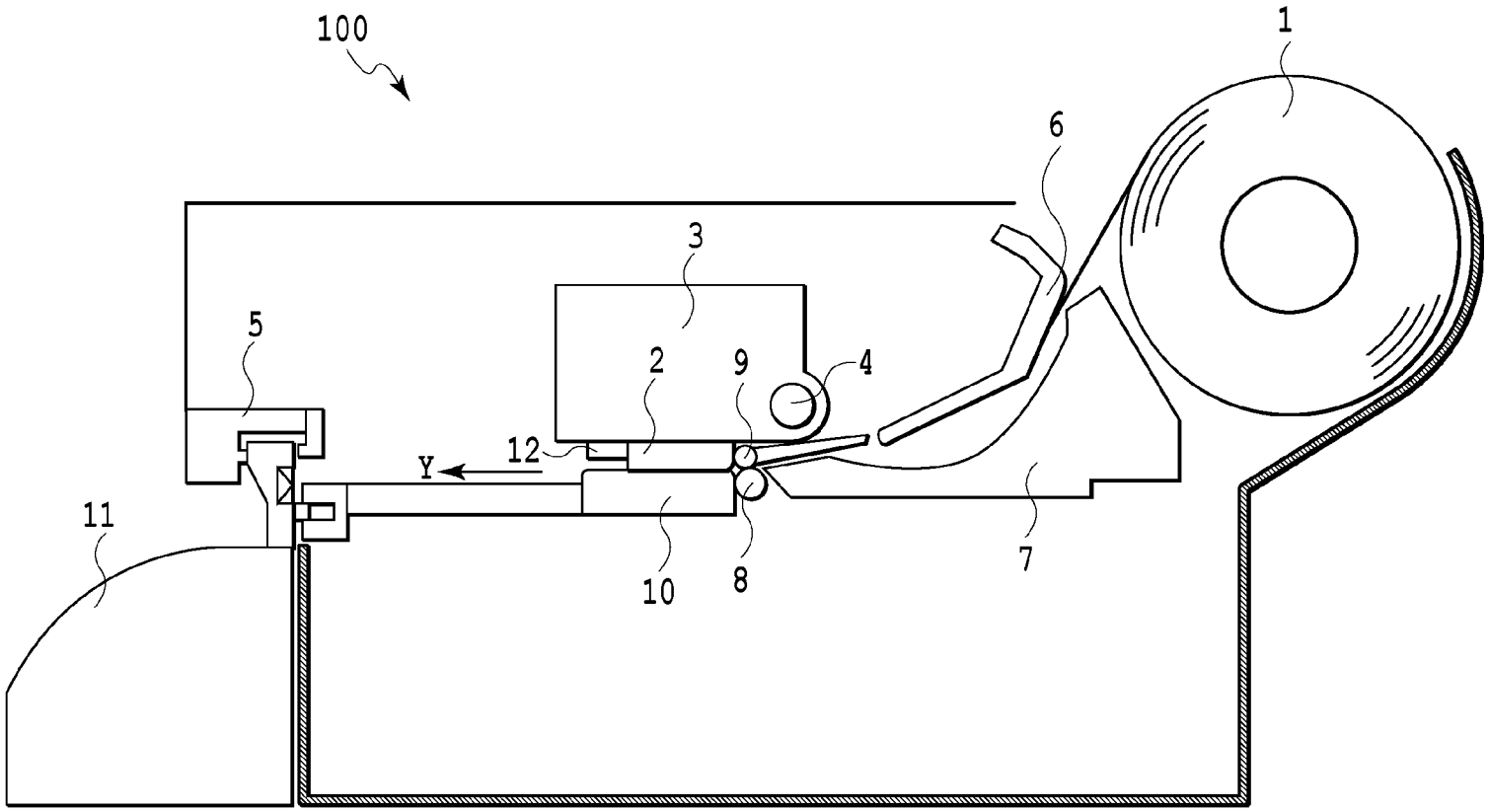
FIG. 1 is a diagram illustrating the schematic structure of a printing apparatus according to the invention.

FIG. 1 is a sectional view of an ink jet printing apparatus 100 according to an embodiment of the invention. A continuous sheet 1, which is wound into a roll, is held in the printing apparatus 100, and the sheet 1 is sent through a conveying path between an upper guide 6 and a lower guide 7. The sheet 1 is held at a nip portion between a conveying roller 8 and a pinch roller 9, is conveyed in a conveying direction, which is indicated by an arrow Y, and is sent onto a platen 10 disposed at a printing position that faces a printing head 2. Images are printed on the sheet 1, which is conveyed to the printing position, with ink ejected from the printing head 2. The printing head 2, a carriage 3 for printing on which the printing head 2 is mounted, and the platen 10 that is disposed so as to face the printing head 2 form an image printing unit. A carriage shaft 4 and a guide rail (not illustrated) are disposed in the printing apparatus 100 so as to be parallel to each other, and the carriage 3 is guided so as to be capable of reciprocating along the carriage shaft 4 and the guide rail in a direction crossing the conveying direction Y (orthogonal to the conveying direction Y in the case of this embodiment). A sheet end sensor 12, which is provided on the carriage 3, moves together with the carriage 3 and detects the position of an end portion of the sheet 1. After the image printing unit prints an image corresponding to one line, with the forward movement or reverse movement of the carriage 3, the image printing unit conveys the sheet 1 by a predetermined distance in the conveying direction and then prints an image corresponding to the next line, with the movement of the carriage 3. A printed portion (a portion having been subjected to printing) of the sheet 1 on which images have been printed is conveyed toward a sheet discharge guide 11.

Images can be sequentially printed on the sheet 1 by the repetition of this operation. A portion of the sheet 1 on which predetermined images have been printed is cut at a cutting position of a cutting apparatus 5. The sheet, which has been cut, (cut sheet) is discharged to the outside of the printing apparatus 100 from the sheet discharge guide 11. The printing apparatus 100 is not limited to only a serial scan system described in this embodiment, and may be a so-called full line system and the like and may be a printing system other than an ink jet system.

Figure 2:
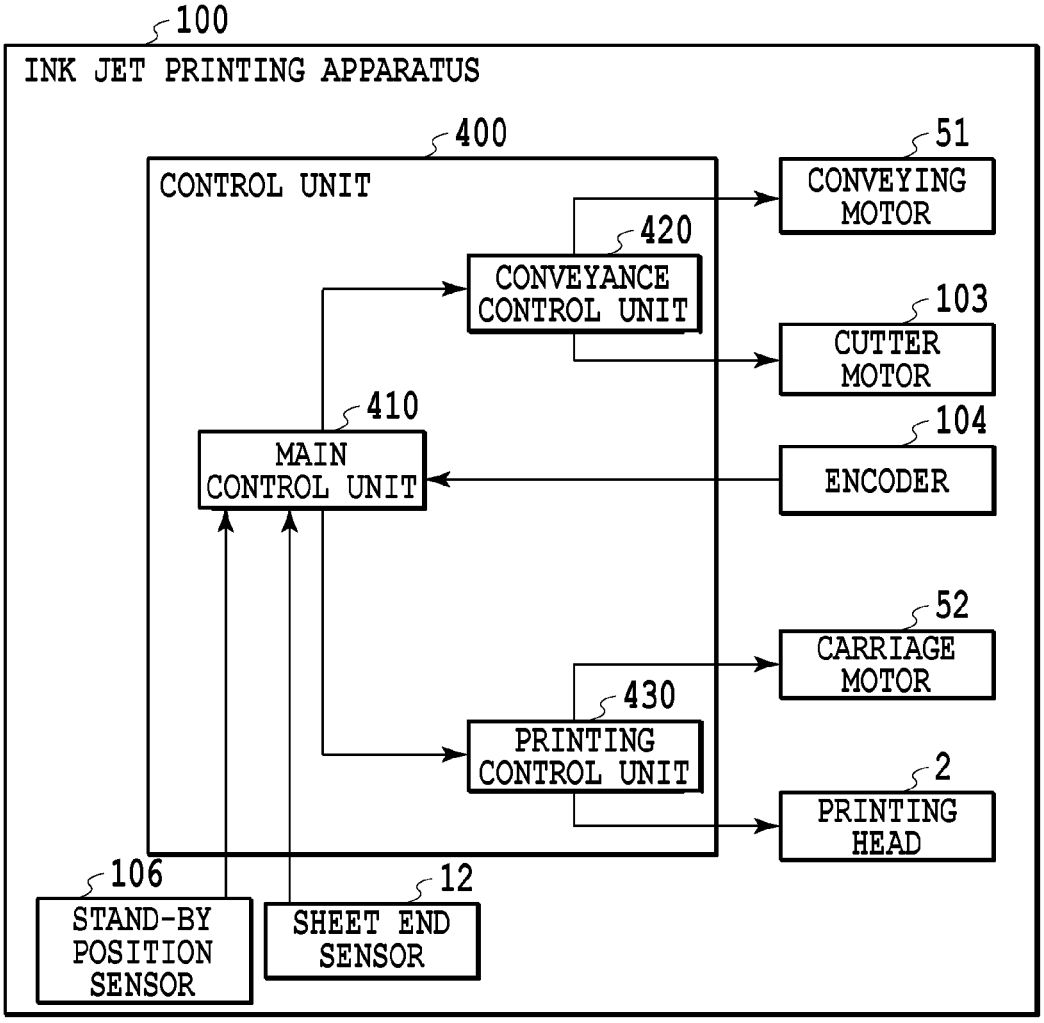
FIG. 2 is a block diagram of a control system of the printing apparatus of FIG. 1.

FIG. 2 is a block diagram illustrating the configuration of a control system of the printing apparatus 100.

A control unit 400 provided in the printing apparatus 100 controls a conveying motor 51, a cutter motor 103, a carriage motor 52, and the printing head 2 on the basis of signals sent from an encoder 104 of the cutter motor 103, the sheet end sensor 12, and a stand-by position sensor 106. The control unit 400 is provided with a CPU, a ROM, a RAM, and a motor driver (not illustrated), and the like, and includes a main control unit 410, a conveyance control unit 420, and a printing control unit 430. The main control unit 410 gives instructions to the conveyance control unit 420 and the printing control unit 430. Under the control of the main control unit 410, the conveyance control unit 420 rotates the conveying roller 8 by the conveying motor 51 to convey the sheet 1 and operates the cutting apparatus 5 by the cutter motor 103 to cut the sheet 1. The printing control unit 430 performs printing of images on the sheet 1 by the movement of the carriage 3, which is performed by the carriage motor 52, and an operation for ejecting ink from the printing head 2.

(Schematic structure of cutting apparatus)

Figure 3:
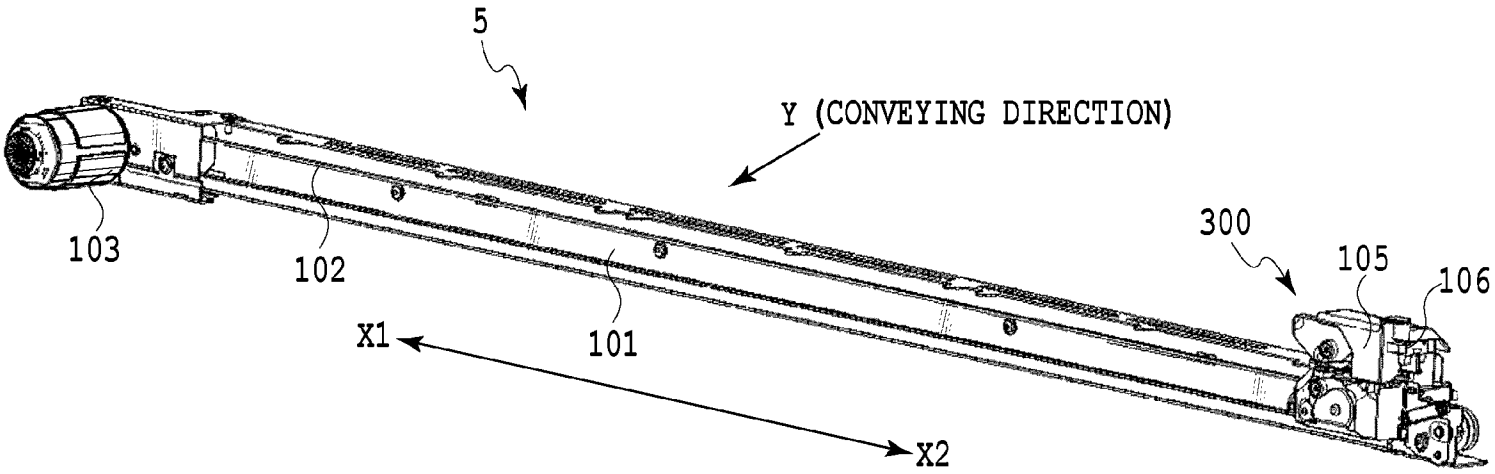
FIG. 3 is a perspective view of a cutting apparatus of FIG. 1.
Figure 4:
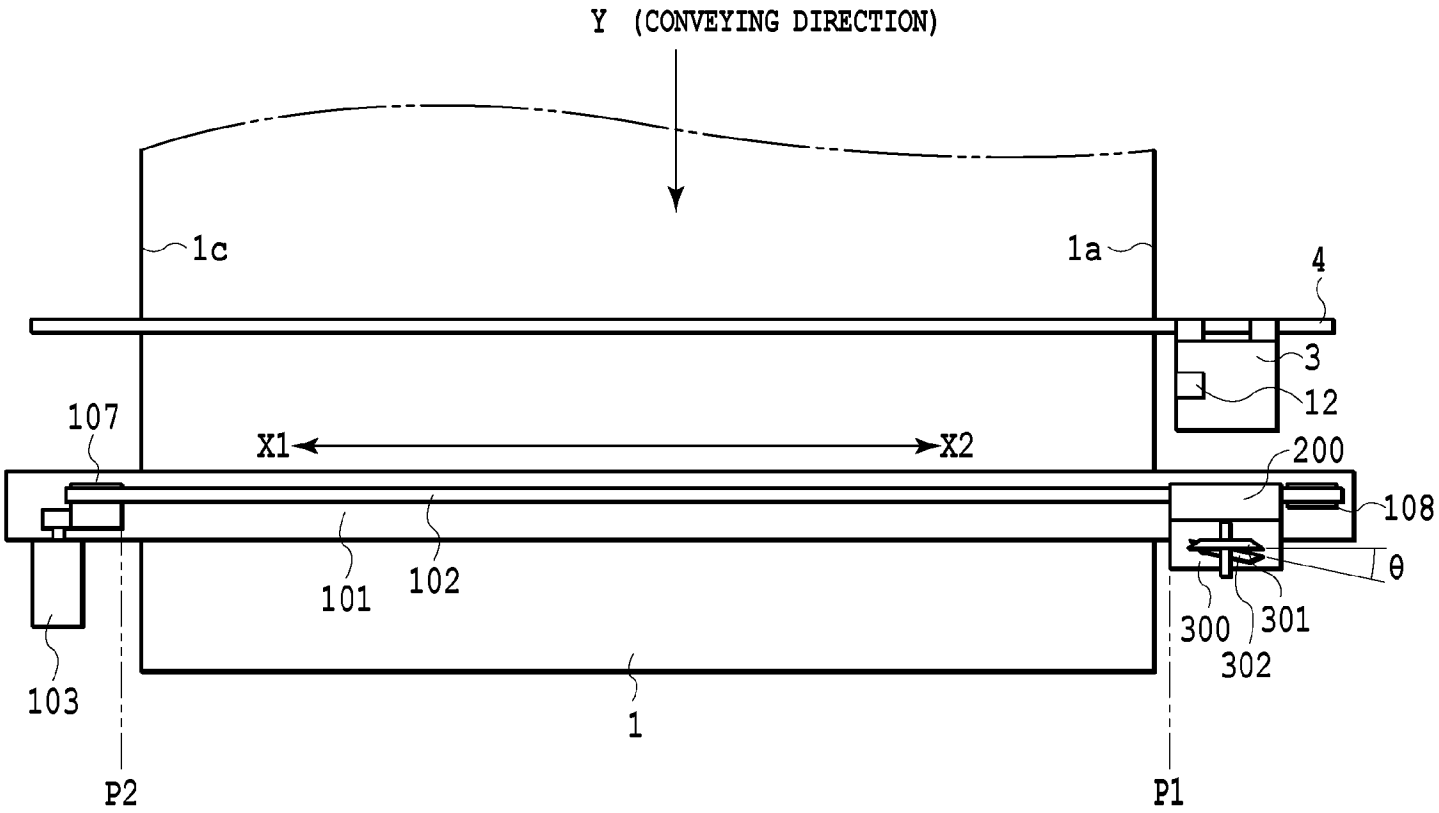
FIG. 4 is a plan view of the cutting apparatus.
Figure 5:
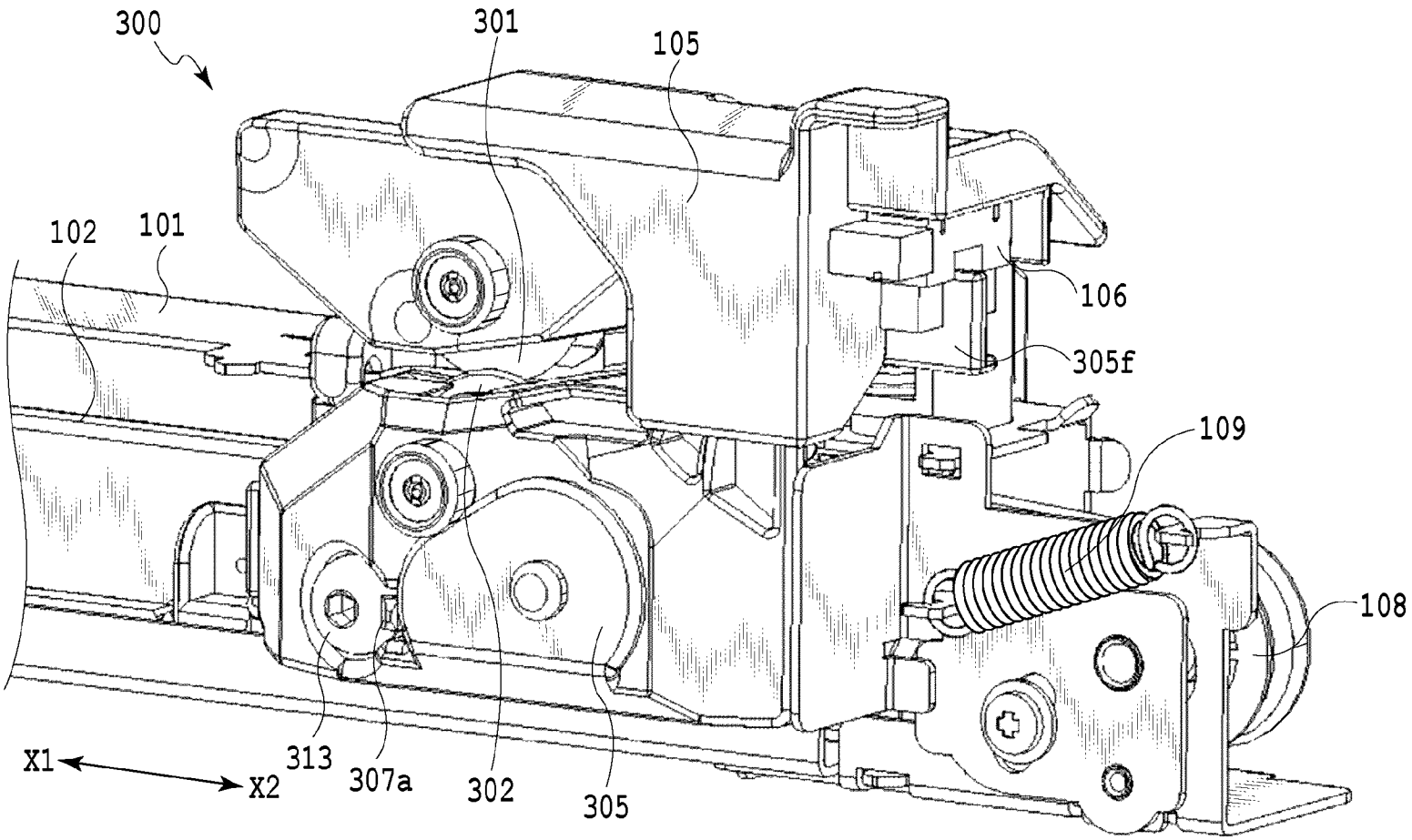
FIG. 5 is a perspective view of the cutting apparatus.

FIG. 3 is a perspective view of the entire cutting apparatus 5, FIG. 4 is a plan view of a peripheral portion of the cutting apparatus 5 provided in the printing apparatus 100, and FIG. 5 is a perspective view of main parts of the cutting apparatus 5.

The cutting apparatus 5 includes a guide rail 101, a toothed belt 102, a carriage 200, and a cutter unit 300. The guide rail 101 guides the carriage 200 in a direction crossing the conveying direction of the sheet 1 (the direction of the arrow Y) so that the carriage 200 can reciprocate. In the case of this embodiment, the carriage 200 is guided so as to be capable of reciprocating in the directions of arrows X1 and X2 which are orthogonal to the conveying direction. The carriage 200 is connected to the belt 102. The cutter motor 103 and a motor pulley 107 are disposed at one end of the guide rail 101, and a tensioner pulley 108 and a tensioner spring 109 are disposed at the other end of the guide rail 101. The belt 102 is stretched between the motor pulley 107 and the tensioner pulley 108. The tensioner pulley 108 is biased in the direction of the arrow X2 by the tensioner spring 109, so that tension is applied to the belt 102, preventing jumping of the teeth of the belt 102.

As described below, the cutter unit 300 is attached to the carriage 200 so as to be capable of being replaced in a joining direction (an attaching direction). The cutter unit 300 includes a disc-shaped upper rotary blade 301 and a disc-shaped lower rotary blade 302 that can cut the sheet 1. These rotary blades 301 and 302 are disposed so as to cross each other at a predetermined angle θ (a crossing angle) with respect to a direction X1 that is a cutting direction as in FIG. 4, and the sheet 1 is cut at a contact point between the rotary blades 301 and 302. The cutter unit 300 reciprocates in the directions of the arrows X1 and X2 together with the carriage 200, and cuts the sheet 1 when moving in the direction of the arrow X1. As described below, the carriage 200 obtains torque from the relative movement of itself and the belt 102 and rotationally drives the lower rotary blade 302 by the torque. Accordingly, both the lower rotary blade 302 and the upper rotary blade 301, which is in contact with the lower rotary blade 302, rotate at the time of the cutting of the sheet 1.

The cutter unit 300 stands by at a stand-by position P1 provided outside an end portion 1*a* of the sheet 1 during the printing of images, and moves from the stand-by position P1 in the cutting direction, which is indicated by the arrow X1, at the time of the cutting of the sheet 1. After the cutting of the sheet 1, the cutter unit 300 is reversed at a reverse position P2 corresponding to the width of the sheet 1, returns to the stand-by position P1, and stands by at the stand-by position P1 by for the next cutting operation. The movement of the cutter unit 300 in the direction of the arrow X2 does not contribute to the cutting operation.

The position of the cutter unit 300 the directions X1 and X2 can be controlled on the basis of output signals (pulse signals) of the encoder 104 provided on the cutter motor 103. Since a relationship between the number of pulses of the encoder 104 and the moving distance of the cutter unit 300 is known in advance, the moving distance of the cutter unit 300 is determined by counting the number of pulses of the encoder 104. A sensor holder 105 is fixed at a fixed position in the vicinity of the stand-by position P1, and the sensor holder 105 is provided with the stand-by position sensor 106. A sensor flag part 305*f* provided on the cutter unit 300 is detected by the stand-by position sensor 106, so that the cutter unit 300 can be accurately stopped at the stand-by position P1. Further, whether or not the cutter unit 300 is present at the stand-by position P1 can also be detected by the stand-by position sensor 106.

(Structure of Carriage)

Figure 6:
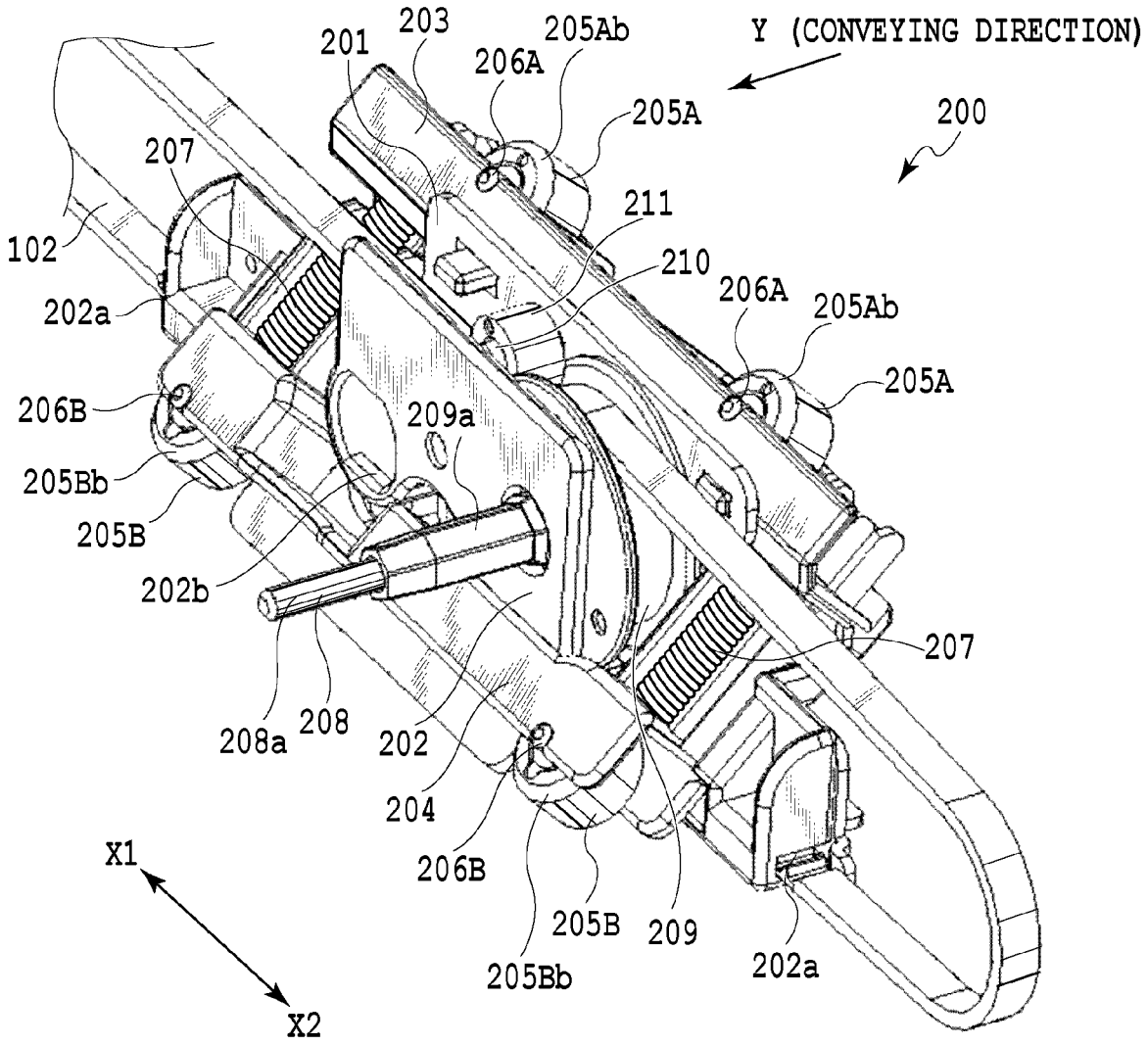
FIG. 6 is a perspective view of a cutter carriage of the cutting apparatus.
Figure 7:
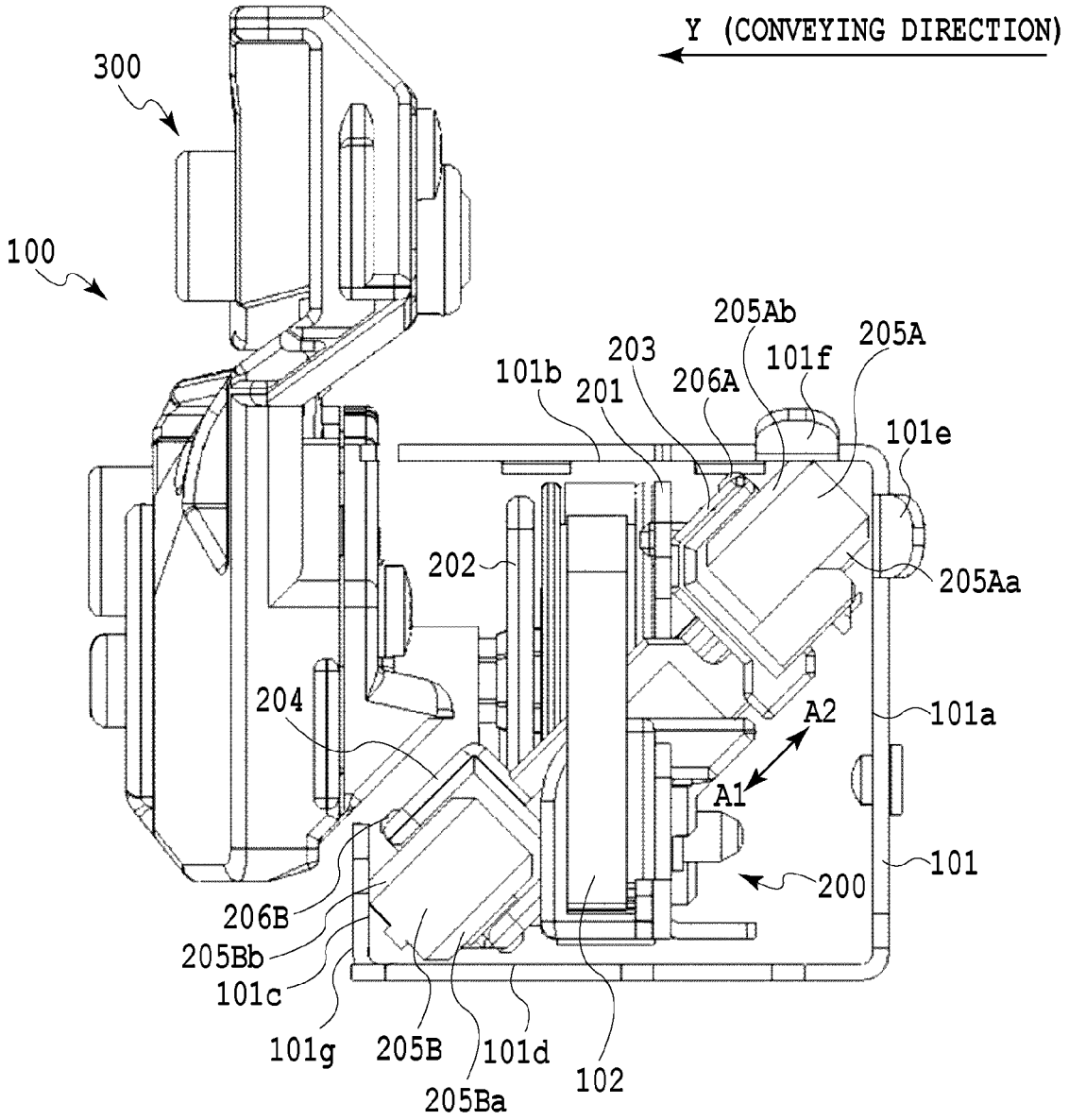
FIG. 7 is a side view of the cutting apparatus.

FIG. 6 is a perspective view of the carriage 200 and FIG. 7 is a side view of the cutting apparatus 5.

The carriage 200 is disposed in the guide rail 101 that includes four guide surfaces 101*a*, 101*b*, 101*c*, and 101*d* as described below. The carriage 200 includes a carriage chassis 201, a carriage holder 202, an upper roller holder (a first holder) 203, and a lower roller holder (a second holder) 204. Both end portions of the belt 102 are inserted and connected to a belt insertion portion 202*a* of the carriage holder 202. The carriage holder 202 is fixed to the carriage chassis 201. The roller holders 203 and 204 hold rollers (rotating bodies) as guide bodies which are described below.

When a small gap is formed between the carriage 200 and the guide rail 101 for the smooth movement of the carriage 200 along the guide rail 101, the carriage 200 is displaced in the range of the gap. Since the rotary blades 301 and 302 of the cutter unit 300 are inclined to each other at the predetermined angle θ (the crossing angle) as described above, a force for displacing the cutter unit 300 to the upstream side in the conveying direction is applied to the cutter unit 300 during the cutting of the sheet 1. For this reason, there is a concern that the carriage 200 may be displaced to the upstream side in the conveying direction during the cutting of the sheet 1. When the position of the cutter unit 300, which is integrally attached to the carriage 200, is displaced cutting at the time cutting is started, there is a case in which a cut portion of the sheet 1 may be bent with respect to the conveying direction. Accordingly, the carriage 200 needs to be disposed in the guide rail 101 without a gap therebetween, and the load of the carriage 200 during the movement of the carriage 200 needs to be reduced.

In this embodiment, a guide mechanism to be described below is provided between the guide rail 101 and the carriage 200.

The upper roller holder 203 is fixed to the carriage chassis 201, and two rollers (first guide bodies) 205A, which are rotatably supported by roller shafts 206A, are disposed on the upper roller holder 203 in the cutting direction of the sheet 1 as in FIG. 6. The lower roller holder 204 is held by the carriage holder 202 at a position facing the upper roller holder 203 so as to be slidable in the directions of arrows A1 and A2. That is, the roller holders 203 and 204 are guided so as to be movable in directions in which the roller holders 203 and 204 approach each other and are separated from each other. Two rollers (second guide bodies) 205B, which are rotatably supported by roller shafts 206B, are disposed on the lower roller holder 204 in the cutting direction of the sheet 1, as shown in FIG. 6. Pressing springs 207, which bias the upper and lower roller holders 203 and 204 in the direction in which the upper and lower roller holders 203 and 204 are separated from each other, are disposed between the upper and lower roller holders 203 and 204. Therefore, the upper roller holder 203 is biased in the direction of the arrow A2, that is, in a direction that is inclined toward the upstream side in the conveying direction and the upper side, as shown in FIG. 7. The lower roller holder 204 is biased in the direction of the arrow A1, that is, in a direction that is inclined toward the downstream side in the conveying direction and the lower side, as shown in FIG. 7.

The guide rail 101 includes a first guide surface 101*a*, a second guide surface 101*b*, a third guide surface 101*c*, and a fourth guide surface 101*d* that guide the rollers 205A and 205B. The first and second guide surfaces 101*a* and 101*b* are positioned on planes different from each other and form a first guide portion. The third and fourth guide surfaces 101*c* and 101*d* are positioned on planes different from each other and form a second guide portion. These first and second guide portions face each other inside the guide rail 101. In the case of this embodiment, the first and second guide surfaces 101*a* and 101*b* are positioned on two planes substantially perpendicular to each other. Likewise, the third and fourth guide surfaces 101*c* and 101*d* are positioned on two planes substantially perpendicular to each other. Further, the first and third guide surfaces 101*a* and 101*c* are substantially parallel to each other, and the second and fourth guide surfaces 101*b* and 101*d* are substantially parallel to each other. More specifically, the first and third guide surfaces 101*a* and 101*c* are surfaces orthogonal to the conveying direction of the sheet 1, and the first guide surface 101*a* is positioned on the upstream side of the third guide surface 101*c* in the conveying direction. The second and fourth guide surfaces 101*b* and 101*d* are surfaces orthogonal to a vertical direction, and the second guide surface 101*b* is positioned above the fourth guide surface 101*d*.

A tapered portion (a first portion to be guided) 205Aa is formed at one peripheral edge of two peripheral edges of the roller 205A, and a tapered portion (a second portion to be guided) 205Ab is formed at the other peripheral edge thereof. The upper roller holder 203, which is biased in the direction of the arrow A2, presses the tapered portion 205Aa against the first guide surface 101*a* and presses the tapered portion 205Ab against the second guide surface 101*b*. A tapered portion (a fourth portion to be guided) 205Ba is formed at one peripheral edge of two peripheral edges of the roller 205B, and a tapered portion (a third portion to be guided) 205Bb is formed at the other peripheral edge thereof. The lower roller holder 204, which is biased in the direction of the arrow A1, presses the tapered portion 205Ba against the fourth guide surface 101*d* and presses the tapered portionA4 205Bb against the third guide surface 101*c*. The pressing spring 207 biases the upper roller holder 203 in the direction of the arrow A2 toward a corner between the first and second guide surfaces 101*a* and 101*b*, and the pressing spring 207 biases the lower roller holder 204 in the direction of the arrow A1 toward a corner between the third and fourth guide surfaces 101*c* and 101*d*. Accordingly, since the tapered portions of the rollers 205A and 205B are reliably pressed against the corresponding guide surfaces of the guide rail 101 and the carriage 200 is disposed in the guide rail 101 without a gap therebetween, the stable posture of the carriage 200 can be maintained. Since the carriage 200 has a function to remove a gap between itself and the guide rail 101 as described above, the carriage 200 does not need to separately include a structure for removing the gap. Accordingly, the size of the apparatus can be reduced as much as that.

In this embodiment, two rollers are disposed on each of the upper and lower roller holders 203 and 204, that is, a total of four rollers are disposed. However, a total of three or more rollers may be disposed. That is, when a plurality of rollers are provided on one roller holder of the upper and lower roller holders 203 and 204 and two or more rollers are provided on the other roller holder thereof, the posture of the carriage 200 can be stabilized with respect to the guide rail 101. Further, two pressing springs 207 are provided between the upper and lower roller holders 203 and 204 in this embodiment. However, the number of the pressing springs 207 to be disposed may be one or more.

The carriage 200 is allowed to reciprocate in the directions of the arrows X1 and X2 through the belt 102 by the cutter motor 103. As the carriage 200 is moved, the rollers 205A and 205B provided on the upper and lower roller holders 203 and 204 rotate while being in contact with the corresponding guide surfaces 101*a*, 101*b*, 101*c*, and 101*d*. Accordingly, since the rollers 205A and 205B are always in contact with the guide rail 101 during the reciprocation of the carriage 200, the rollers 205A and 205B can restrict the position of the carriage 200 in the vertical direction and a horizontal direction in FIG. 7. As a result, the displacement of the cutter unit 300 mounted on the carriage 200 from the time of the start of cutting is suppressed, and the generation of the bending of the cut portion of the sheet 1 can be suppressed. Further, since the rollers 205A and 205B rotate, the load of the carriage 200 during the movement of the carriage 200 can be reduced.

Furthermore, in this embodiment, the upper roller holder 203 is fixed to the carriage chassis 201 and the lower roller holder 204 is provided so as to be movable relative to the carriage holder 202, which is fixed to the carriage chassis 201, in the directions of arrows A1 and A2. For this reason, even though a force in the direction of the arrow A2 (toward the upstream side in the conveying direction and the upper side) is applied to the carriage 200 mounted on the carriage chassis 201, the carriage 200 does not move in the direction of the arrow A2. Accordingly, even when the cutter unit 300 receives a force applied to the upstream side in the conveying direction due to the angle θ (the crossing angle) at the time of the cutting of the sheet, the carriage 200 does not move in the direction of the arrow A2 and the cutting position of the sheet 1 is restricted to a regular position.

Tapered guide portions 101*e* and 101*f*, which guide the carriage 200 when the carriage 200 is assembled from the side surface of the guide rail 101, are formed on the guide rail 101. The tapered guide portion 101*e* is formed so as to smoothly continue to the first guide surface 101*a*, which is positioned on the upstream side in the conveying direction, and is inclined toward the upstream side in the conveying direction. The tapered guide portion 101*f* is formed so as to smoothly continue to the second guide surface 101*b*, which is positioned on the upper side, and is inclined toward the upper side. When the tapered guide portions 101*e* and 101*f* are used, the carriage 200 can be easily assembled from the side surface of the guide rail 101. In addition, the same tapered guide portions may be provided on the third and fourth guide surfaces 101*c* and 101*d* for the improvement of the easy of assembly of the carriage 200.

The carriage chassis 201 is provided with a shaft 208 and a roller shaft 210. An output gear 209 is rotatably supported by the shaft 208, and a roller 211 is rotatably supported by the roller shaft 210. The output gear 209 and the roller 211 form a drive mechanism that rotationally drives the lower rotary blade 302 of the cutter unit 300 according to the relative movement of the carriage 200 and the belt 102. The output gear 209 is engaged with tooth portions of the belt 102. The roller 211 increases the degree of the engagement between the belt 102 and the output gear 209 by guiding the belt 102 so that the length of a portion of the belt 102 wound on the output gear 209 is increased, and suppresses the jumping of teeth between the belt 102 and the output gear 209. When the carriage 200 is allowed to reciprocate in the directions of the arrows X1 and X2 through the belt 102, the output gear 209, being engaged with the belt 102, is rotated about the shaft 208. The output gear 209 forms a supply unit that supplies a force for driving the lower rotary blade 302 of the cutter unit 300. The output gear 209 is provided with an output portion 209*a* that is positioned on the outer peripheral portion of the shaft 208 and has a polygonal cross-section (a hexagonal cross-section in the case of this embodiment), and the output portion 209*a* protrudes on the downstream side in the conveying direction of the sheet 1. The output portion 209*a* transmits torque to the lower rotary blade 302 of the cutter unit 300 as described below.

(Structure of Cutter Unit)

Figure 8:
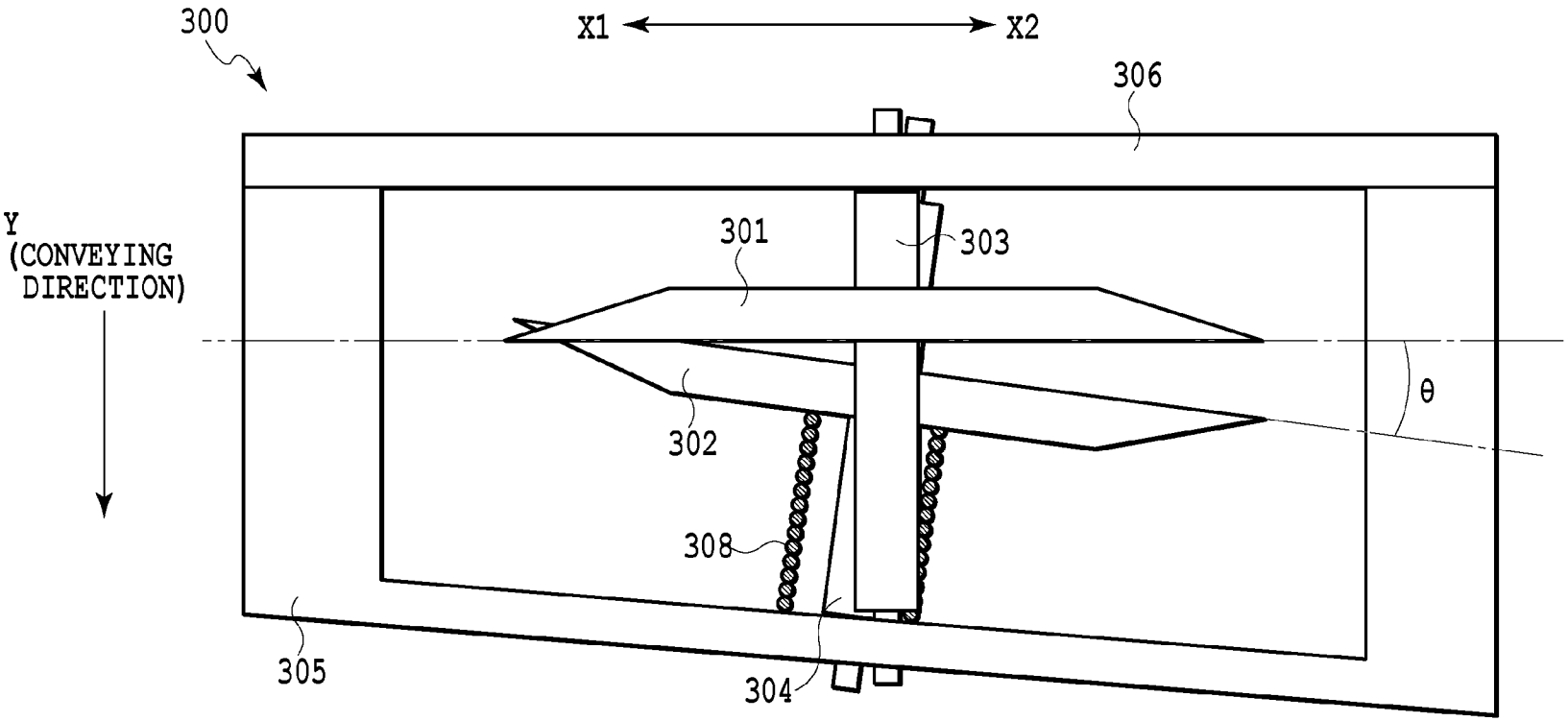
FIG. 8 is an enlarged view of main parts of a cutter unit of the cutting apparatus that are viewed from above.
Figure 9:
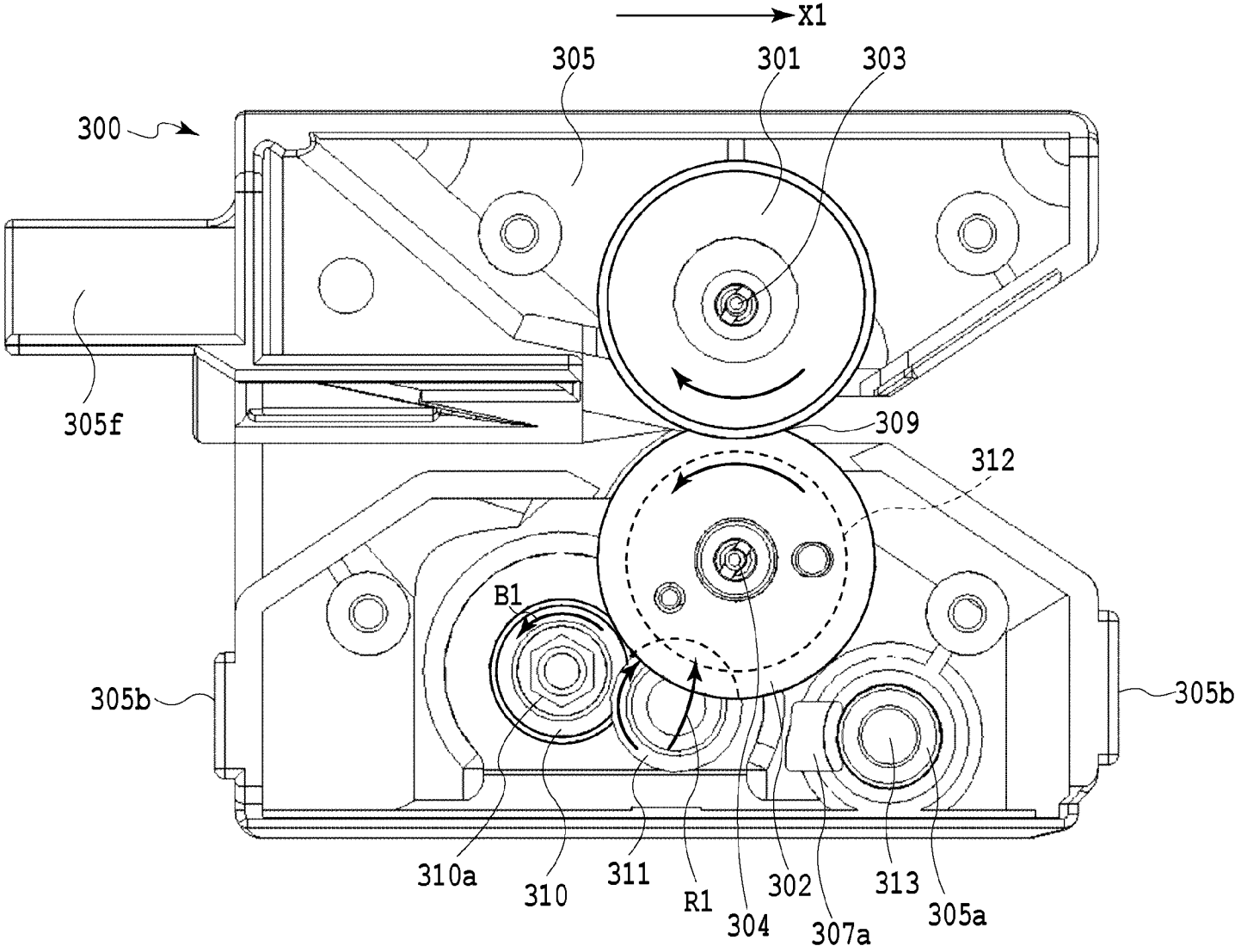
FIG. 9 is a front view of the cutter unit that is moving in a cutting direction.
Figure 10:
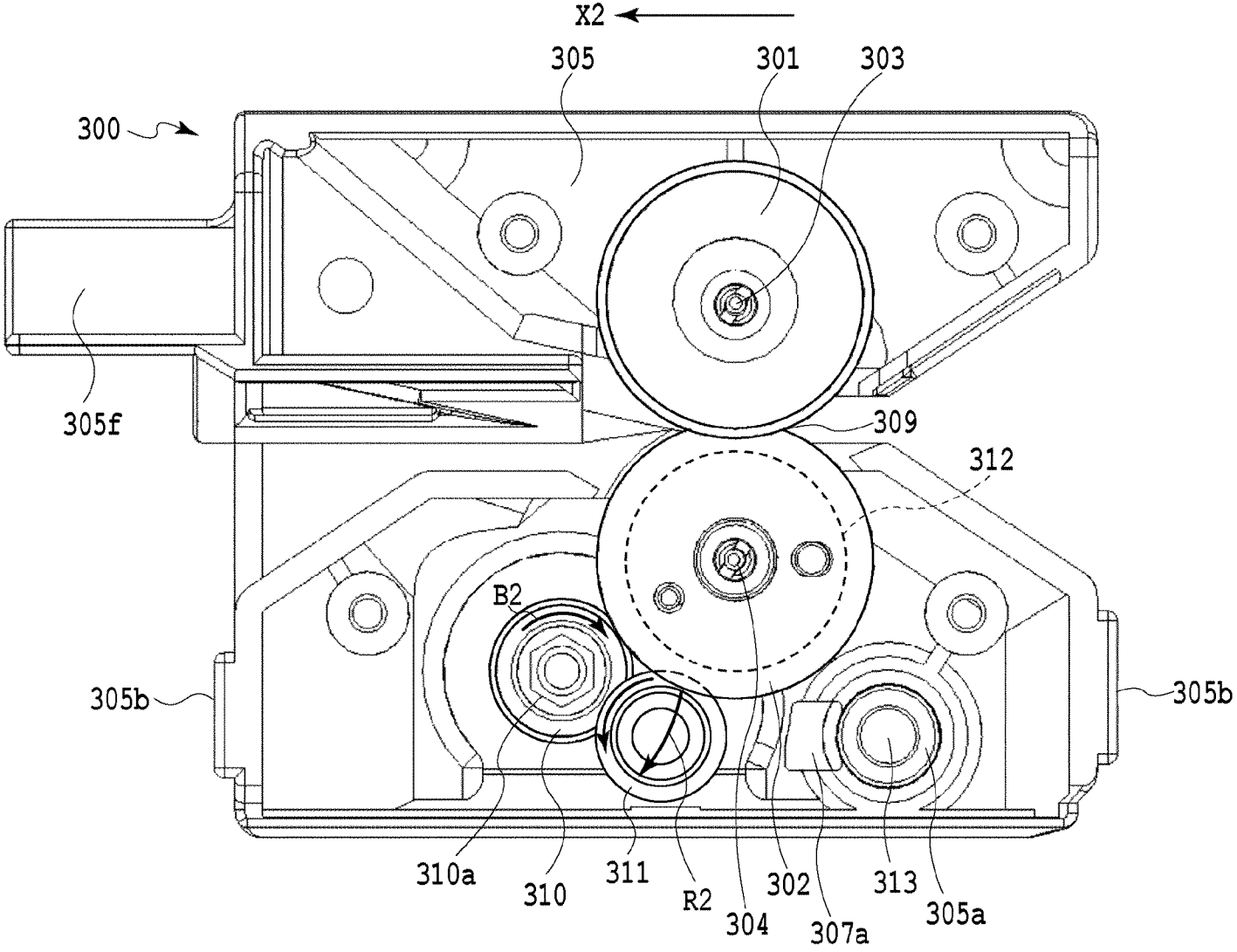
FIG. 10 is a front view of the cutter unit that is moving in a direction opposite to the cutting direction.

FIG. 8 is an enlarged view of the rotary blades 301 and 302 of the cutter unit 300 that are viewed from above, FIG. 9 is a front view when the cutter unit 300 moves in the direction of the arrow X1 (the cutting direction), and FIG. 10 is a front view when the cutter unit 300 moves in the direction of the arrow X2.

The upper rotary blade 301 is a disc-shaped round blade that can rotate integrally with an upper rotating shaft 303, and is disposed above a printed surface of the sheet 1 on which images have been printed. The lower rotary blade 302 is a disc-shaped round blade that can be rotated integrally with a lower rotating shaft 304, and is disposed below a surface of the sheet 1 opposite to the printed surface. The upper rotating shaft 303 is rotatably supported between a main holder 305 and an upper holder 306. The lower rotary blade 302 is disposed on the downstream side of the upper rotary blade 301 in the conveying direction of the sheet 1, and the lower rotating shaft 304 is rotatably supported between the main holder 305 and a lower holder 307 so that the lower rotary blade 302 forms a predetermined angle θ (the crossing angle) with respect to the cutting direction indicated by the arrow X1. Since the lower holder 307 is disposed so as to deviate from the upper holder 306 by a predetermined distance in the direction of the arrow X2, the lower rotating shaft 304 is inclined with respect to the vertical direction in FIG. 8 that is orthogonal to the cutting direction X1. For this reason, the lower rotary blade 302 is inclined with respect to the cutting direction, which is indicated by the arrow X1, by the predetermined angle θ (the crossing angle), so that the crossing angle θ is set. Since a pressing spring 308 positioned around the lower rotating shaft 304 is disposed between the lower rotary blade 302 and the main holder 305, the lower rotary blade 302 is pressed by the pressing spring 308 so as to be in point contact with the upper rotary blade 301. A contact point between the upper and lower rotary blades 301 and 302 forms a cutting point 309, and the sheet 1 is cut at the cutting point 309.

The crossing angle θ with respect to the cutting direction (the direction of the arrow X1) needs to be increased to improve cutting performance through the improvement of the bite of the rotary blades 302 and 301 on a sheet at the time of the start of the cutting of various sheets. However, since the cut surface of the sheet is peeled when the crossing angle θ is too large, there is a concern that much paper powder may be generated in a case in which the sheet is paper, that is, the quality of cutting may deteriorate. For this reason, the rotary blades 302 and 301 need to be positioned so that the crossing angle θ is set with high accuracy. The crossing angle θ is determined by the upper rotary blade 301 of which the position is set by the position of the upper holder 306 assembled to the main holder 305 and the lower rotary blade 302 of which the position is set by the position of the lower holder 307 assembled to the main holder 305. Since the position of each of the upper and lower holders 306 and 307 assembled to the main holder 305 can be finely adjusted, the crossing angle θ can be adjusted by the fine adjustment of the position of each of the upper and lower holders 306 and 307 assembled to the main holder 305. Each of the upper and lower holders 306 and 307 is fixed to the main holder 305 after the adjustment of the crossing angle θ, so that the crossing angle θ is maintained.

The cutter unit 300 includes an input gear 310, a pendulum gear 311, and a rotating gear 312 that forcibly rotate the lower rotary blade 302. The input gear 310 is provided with a hole-like input portion 310*a*, and an inner peripheral portion having a polygonal cross-section (a hexagonal cross-section in the case of this embodiment) is formed in the input portion 310*a*. When the output portion 209*a* of the carriage 200 is fitted to the input portion 310*a*, the output gear 209 and the input gear 310 are connected to each other. The output gear 209 rotates with the reciprocation of the carriage 200 as described above. The torque of the output gear 209 is transmitted to the input gear 310. That is, the input gear 310 is rotated in the directions of arrows B1 and B2 with the movement of the cutter unit 300.

The pendulum gear 311 transmits the unidirectional rotation of the input gear 310 to the rotating gear 312. That is, when the input gear 310 rotates in the direction of the arrow B1 of FIG. 9, the pendulum gear 311 rotates about the shaft of the input gear 310 in the direction of an arrow R1 and rotates to a position at which the pendulum gear 311 is engaged with the rotating gear 312. Then, the pendulum gear 311 transmits rotation to the rotating gear 312. Accordingly, the rotating gear 312 is rotated in the direction of an arrow of FIG. 9. On the other hand, when the input gear 310 rotates in the direction of an arrow B2 of FIG. 10, the pendulum gear 311 rotates about the shaft of the input gear 310 in the direction of an arrow R2 and is stopped at a position illustrated in FIG. 10 by a stopper (not illustrated). Accordingly, the pendulum gear 311 is not engaged with the rotating gear 312 and the rotating gear 312 is not rotated. Since the rotating gear 312 is mounted on the lower rotating shaft 304, the lower rotary blade 302 is also rotated by the rotation of the rotating gear 312. Since the upper rotary blade 301 and the lower rotary blade 302 are in contact with each other at the cutting point 309, the upper rotary blade 301 is driven to rotate when the lower rotary blade 302 rotates.

When the cutter unit 300 is moved in the cutting direction indicated by the arrow X1, the upper and lower rotary blades 301 and 302 rotate in a direction in which these rotary blades 301 and 302 pull the sheet 1 to the cutting point 309 as in FIG. 9. The sheet 1 can be easily cut by the cooperation of the upper and lower rotary blades 301 and 302 that rotate in this way. On the other hand, since the rotation of the pendulum gear 311 is not transmitted to the rotating gear 312 as in FIG. 10 when the cutter unit 300 is moved in the direction of the arrow X2, the upper and lower rotary blades 301 and 302 do not rotate. Accordingly, the wear of the upper and lower rotary blades 301 and 302 is suppressed. As a result, the durability of the upper and lower rotary blades 301 and 302 can be improved.

(Attachment and Detachment of Cutter Unit)

Figure 11:
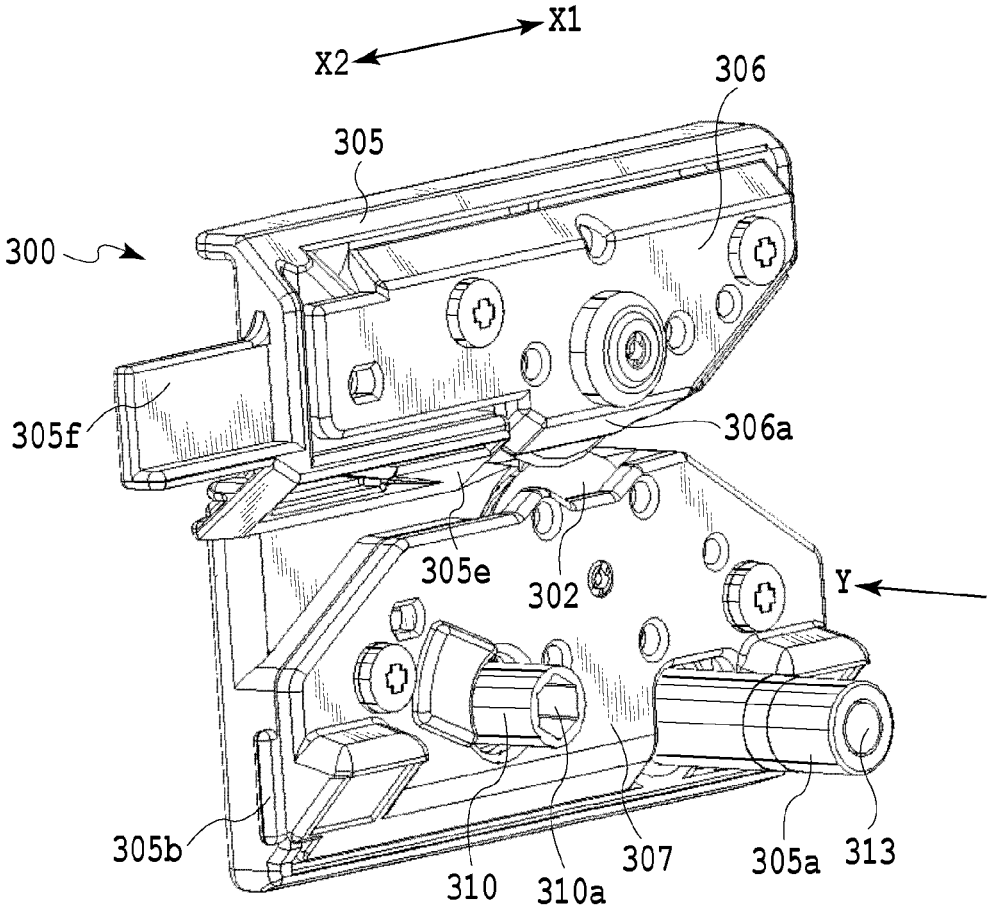
FIG. 11 is a perspective view of the cutter unit that is viewed from the back side.
Figure 12:
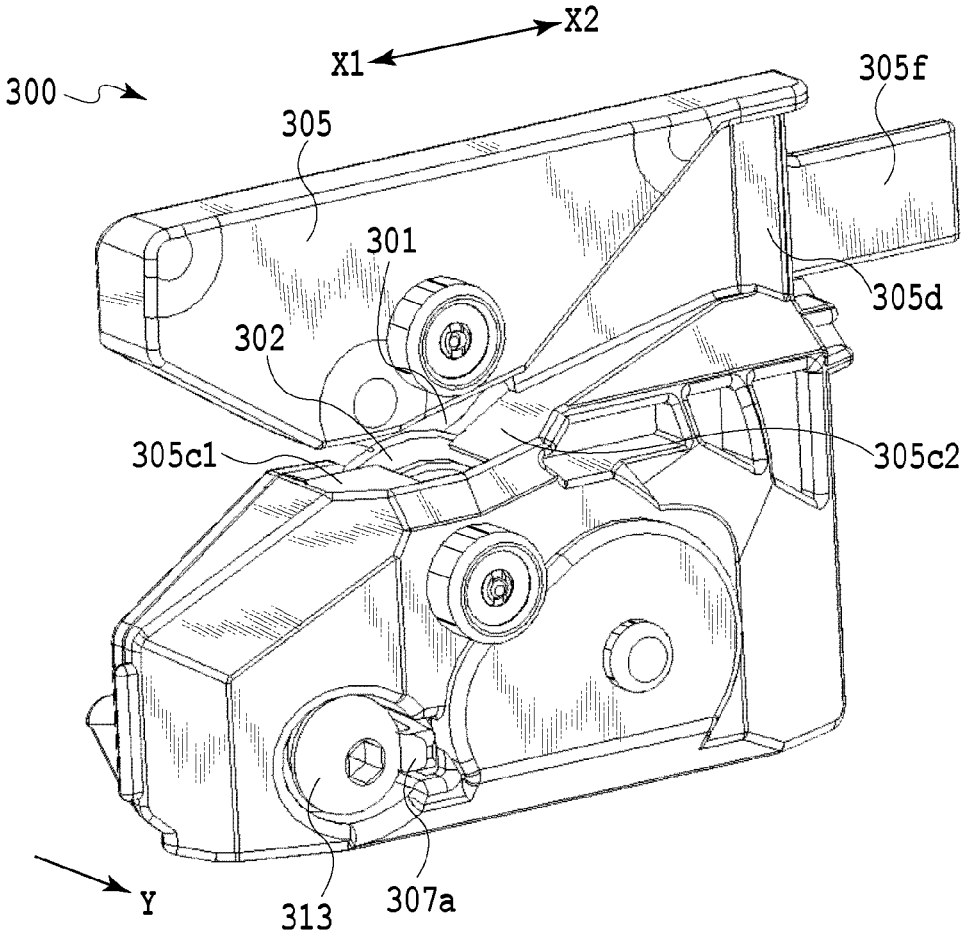
FIG. 12 is a perspective view of the cutter unit that is viewed from the front side.
Figure 13:
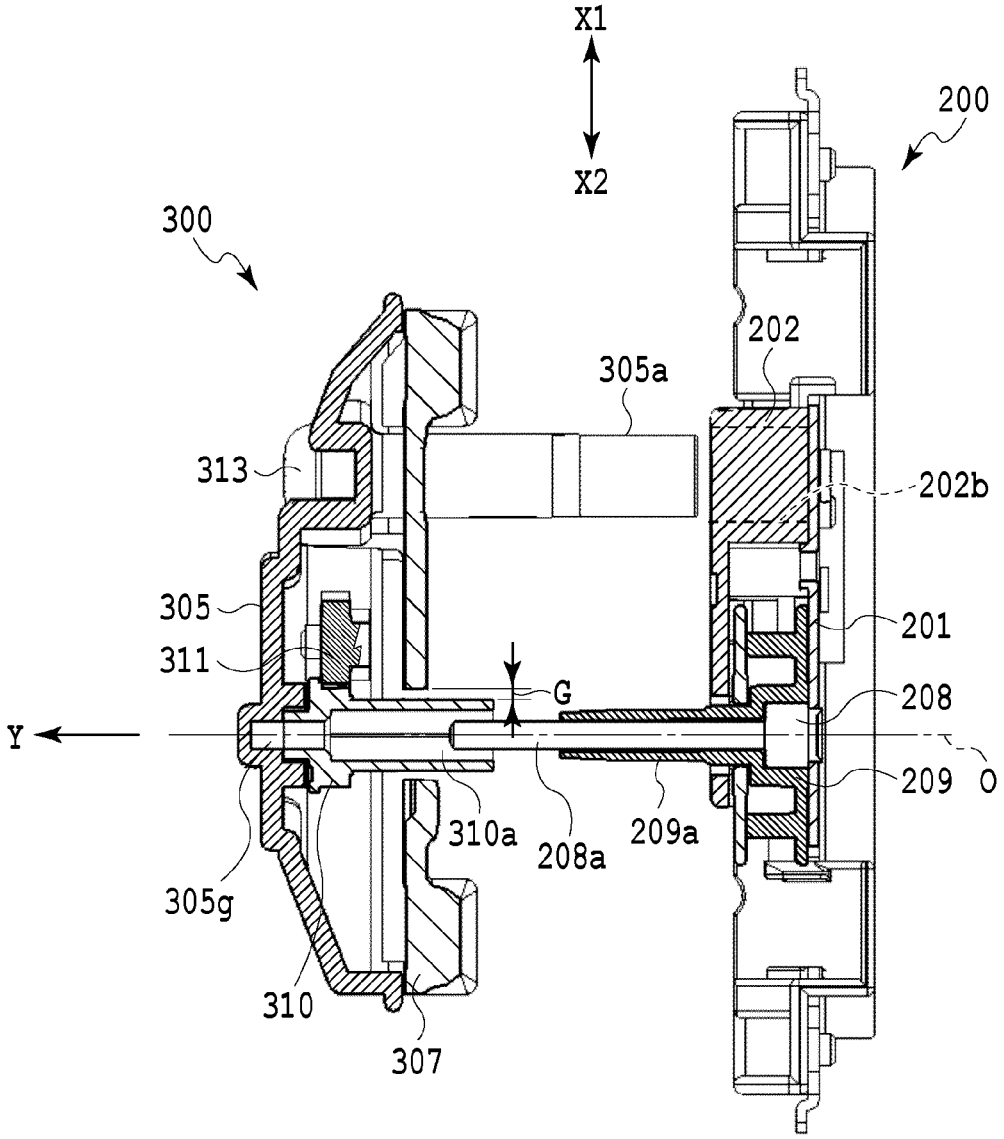
FIG. 13 is a cross-sectional view of main parts of the cutter unit at the time of the start of the mounting of the cutter unit.
Figure 14:
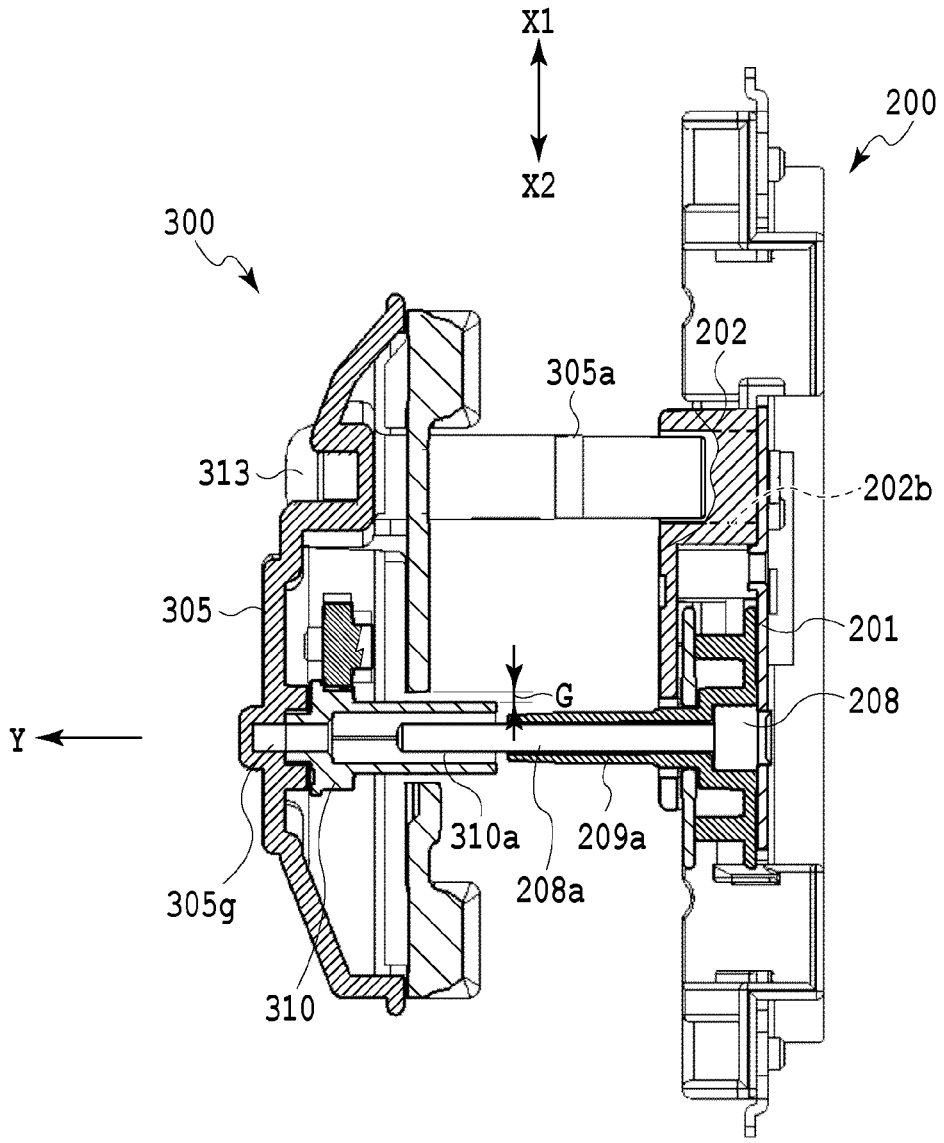
FIG. 14 is a cross-sectional view of main parts of the cutter unit during the mounting of the cutter unit.
Figure 15:
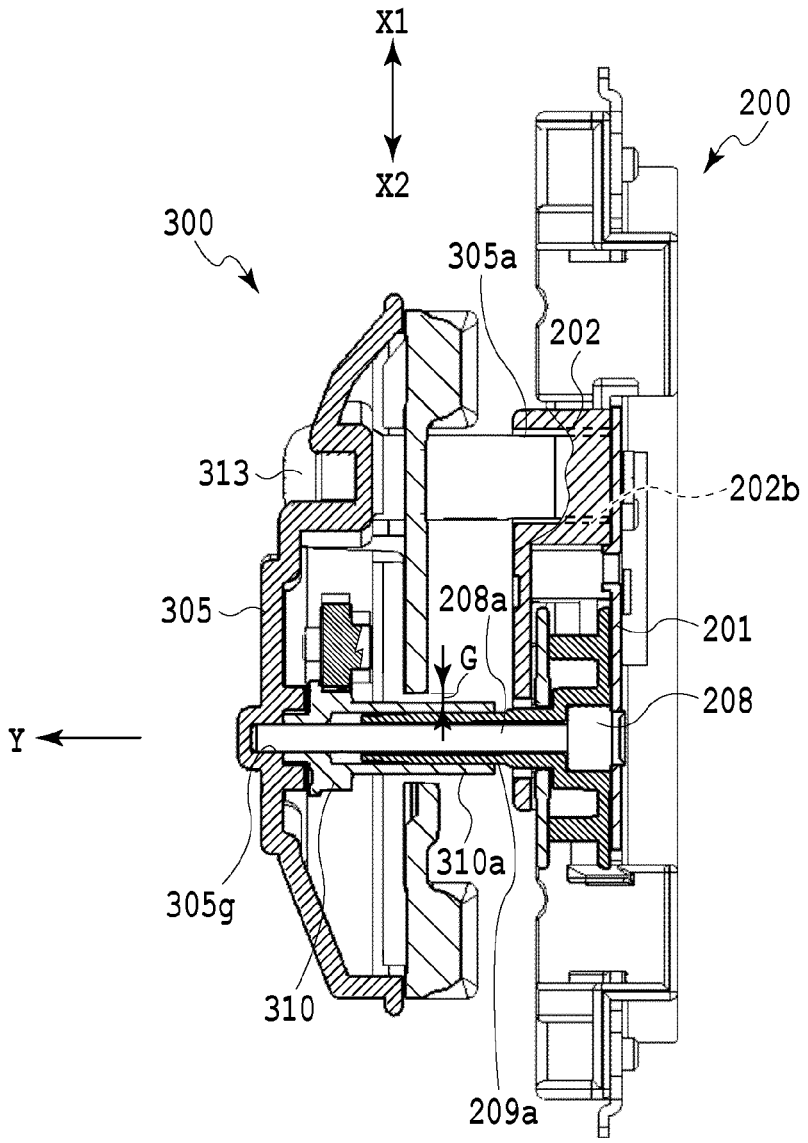
FIG. 15 is a cross-sectional view of main parts of the cutter unit after the mounting of the cutter unit.

The cutter unit 300 is attached to the carriage 200 so as to be capable of being replaced. That is, the cutter unit 300 can be attached to and detached from the carriage 200. FIG. 11 is a perspective view of the cutter unit 300 that is viewed from the back side, and FIG. 12 is a perspective view of the cutter unit 300 that is viewed from the front. FIG. 13 is a cross-sectional view of main parts of the cutter unit 300 at the time of the start of the mounting of the cutter unit 300, FIG. 14 is a cross-sectional view of main parts of the cutter unit 300 during the mounting of the cutter unit 300, and FIG. 15 is a cross-sectional view of main parts of the cutter unit after the mounting of the cutter unit 300.

The shaft 208 of the carriage 200 includes a tip portion 208*a* that protrudes from the tip of the output portion 209*a* toward the downstream side in the conveying direction, and the main holder 305 of the cutter unit 300 includes a positioning hole 305*g*. When the tip portion 208*a* of the shaft 208 is fitted to the positioning hole 305*g*, the cutter unit 300 is positioned. Further, the carriage holder 202 includes a positioning hole 202*b* for the cutter unit 300, and the main holder 305 includes a positioning portion 305*a*. When the positioning portion 305*a* is fitted to the positioning hole 202*b*, the cutter unit 300 is positioned in a direction in which the cutter unit 300 rotates about the output portion 209*a*. When the tip portion 208*a* of the shaft 208 is fitted to the positioning hole 305*g* and the positioning portion 305*a* is fitted to the positioning hole 202*b* as described above, the cutter unit 300 is positioned relative to the carriage 200. When the output portion 209*a* of the carriage 200 is fitted to the input portion 310*a* of the cutter unit 300 as described above, the output gear 209 and the input gear 310 are connected to each other and a driving force transmission system for the lower rotary blade 302 is formed. That is, the output portion 209*a* and the input portion 310*a* form a transmission mechanism that transmits a driving force (rotational driving force) supplied from the carriage 200 to the lower rotary blade 302 of the cutter unit 300. The output portion 209*a*, the input portion 310*a*, the tip portion 208*a* of the shaft 208, and the positioning hole 305*g* are disposed so as to be positioned on the same axis ○ (see FIG. 13) extending in a joining direction in which the carriage 200 and the cutter unit 300 are joined together (a direction in which the cutter unit 300 is attached to the carriage 200).

When the tip portion 208*a* of the shaft 208 is fitted to the positioning hole 305*g* in this way, the cutter unit 300 is positioned and the driving force transmission system for the lower rotary blade 302 is connected by the connection between the output gear 209 and the input gear 310 positioned on the same axis as the shaft 208. That is, the positioning of the cutter unit 300, which is the former, and the connection of the driving force transmission system for the lower rotary blade 302, which is the latter, can be performed without interfering with each other on the same axis. Since both the functions are collectively achieved on the same axis, the workability of the mounting of the cutter unit 300 can be improved and a space can be saved in comparison with a case in which portions where these functions are achieved are set to positions spaced apart from each other. If portions where both the functions are achieved are set to separate positions spaced apart from each other, individual fitting work needs to be performed at each of these portions and the fitting of the other portion is difficult when one portion is fitted first. Further, the output portion 209*a* is set to be longer than the positioning portion 305*a* in this embodiment so that the positioning portion 305*a* is inserted into the positioning hole 202*b* after the output portion 209*a* is inserted into the input portion 310*a*. When an order of fitting is set in this way, the workability of the mounting of the cutter unit 300 can be more improved.

A receiving portion, which receives a fixing screw 313, is formed in the positioning portion 305*a*. The positioning portion 305*a* has the shape of a cylinder that extends in the joining direction in which the cutter unit 300 is joined, and the fixing screw 313 is disposed so as to be positioned on the central axis of the positioning portion 305*a*. When the fixing screw 313 is screwed into a portion of the carriage chassis 201 that is positioned on the bottom of the positioning hole 202*b*, the cutter unit 300 is fixed to the carriage 200. A function to position the cutter unit 300 by the positioning portion 305*a* and the positioning hole 202*b* and a function to fix the cutter unit 300 by the fixing screw 313 provided in the positioning portion 305*a* are collectively achieved on the same axis in this way. Accordingly, the workability of the mounting of the cutter unit 300 can be improved and a space can be saved in comparison with a case in which portions where these functions are achieved are set to separate positions spaced apart from each other. Further, the positioning portion 305*a* and the positioning hole 202*b* function as a rotation preventing mechanism that prevents the relative rotation of the carriage 200 and the cutter unit 300 about the axis ○.

The main holder 305 is provided with a claw 307*a*, which is caught on the head of the fixing screw 313, to prevent the falling of the fixing screw 313 provided in the positioning portion 305*a*. Accordingly, when the cutter unit 300 is detached from the carriage 200, the falling of the fixing screw 313 can be prevented. The position of the claw 307*a* is set so that the fixing screw 313 is received in the positioning portion 305*a* over the entire length thereof in a state in which the head of the fixing screw 313 is caught on the claw 307*a* and the falling of the fixing screw 313 is prevented. When the cutter unit 300 is mounted on the carriage 200, the generation of a damage and the like caused by the contact between the tip portion of the fixing screw 313 and a peripheral portion of the positioning hole 202*b* can be prevented since the tip portion of the fixing screw 313 is received in the positioning portion 305*a*. As in FIGS. 11 and 12, the fixing screw 313 is disposed on a front side of the cutter unit 300 in the cutting direction (the direction of the arrow X1), and the input portion 310*a* is disposed on a rear side of the cutter unit 300 in the cutting direction. Since the fixing screw 313 is disposed on the front side in the cutting direction, the cutting resistance of the sheet 1 can be effectively received by a portion that is fixed by the fixing screw 313, the wobble of the cutter unit 300 can be prevented, and the posture of the cutter unit 300 can be stabilized.

When the cutter unit 300 is mounted on the carriage 200, the tip portion 208*a* of the shaft 208 is inserted into the input portion 310*a* first as in FIG. 13. The tip portion 208*a* is thinner than the output portion 209*a* and has a tapered shape, the diameter of the tip portion 208*a* is set to be sufficiently smaller than the inner diameter of the input portion 310*a*, and the tip portion 208*a* serves as an initial guide portion when the cutter unit 300 is mounted. That is, the position of the cutter unit 300 is roughly restricted by the fitting of the tip portion 208*a* to the input portion 310*a*. Since the tip portion 208*a* is set to be longer than the positioning portion 305*a* as described above, the positioning portion 305*a* is not yet inserted into the positioning hole 202*b* in a state in which the tip portion 208*a* starts to be inserted into the input portion 310*a* as in FIG. 13.

Further, the input gear 310 is allowed to oscillate and slide with respect to the insertion direction of the shaft 208 by a gap G as in FIG. 13, in a state in which the cutter unit 300 is detached from the carriage 200. That is, the input gear 310 in which the input portion 310*a* is formed can be displaced in a direction crossing the joining direction in which the cutter unit 300 is attached to the carriage 200. This gap G may allow the input gear 310 to only oscillate or to only slide. Furthermore, since the gap G is set so as to allow the input gear 310 to be inclined in a range in which at least the tooth bottom of the input gear 310 and the tooth bottom of the pendulum gear 311 do not come into contact with each other, the input gear 310 can be slightly inclined with respect to the cutter unit 300.

Accordingly, even though the position of the cutter unit 300 relative to the carriage 200 slightly deviates when the cutter unit 300 is attached to the carriage 200, the input portion 310*a* guides the output portion 209*a* while being inclined. As a result, the workability of the mounting of the cutter unit 300 can be improved. In addition, in order to secure a clear view, a user can mount the cutter unit 300 so that the cutter unit 300 is inclined.

Here, the input portion 310*a* and the output portion 209*a* have the same color (which means the same color or a similar color in this specification) that is different from the colors of other peripheral components. Accordingly, even when a user mounts the cutter unit 300 for the first time, the user can visually understand a relationship between the input portion 310*a* and the output portion 209*a* and can easily fit the output portion 209*a* to the input portion 310*a*.

When the cutter unit 300 is further inserted, the positioning portion 305*a* is inserted into the positioning hole 202*b*, as shown in FIG. 14. At this time, the output portion 209*a* is not inserted into the input portion 310*a*. For this reason, since the cutter unit 300 can be moved in a range that is restricted by the input portion 310*a* and the tip portion 208*a*, the positioning portion 305*a* is easily inserted into the positioning hole 202*b*.

After that, when the cutter unit 300 is still further inserted, the output portion 209*a* is inserted into the input portion 310*a* as shown in FIG. 15. Accordingly, the output portion

209*a* and the input portion 310*a* are connected to each other. Further, since the tip portion 208*a* is inserted into the positioning hole 305*g*, the cutter unit 300 is positioned relative to the carriage 200. Accordingly, after the positioning portion 305*a* is inserted into the positioning hole 202*b*, as shown in FIG. 14, the output portion 209*a* is inserted into the input portion 310*a* and the tip portion 208*a* is inserted into the positioning hole 305*g*, as shown in FIG. 15. Since the timing of insertion of the positioning portion 305*a*, the timing of insertion of the output portion 209*a* and the tip portion 208*a* are shifted from each other in this way, the workability of mounting can be improved in comparison with a case in which the positioning portion 305*a*, the output portion 209*a*, and the tip portion 208*a* are simultaneously inserted.

As described above, the shaft (shaft portion) 208, the positioning hole 305*g* to which the shaft 208 is fitted, the output portion 209*a*, and the input portion 310*a* to which the output portion 209*a* is inserted form first fitting sections that are provided at positions, which face each other, on the carriage 200 and the cutter unit 300. Further, the protruding shaft 208 and the protruding output portion 209*a* form a carriage-side protruding portion, and the recessed positioning hole 305*g* and the input portion 310*a* form a cutter unit-side recessed portion. Furthermore, the positioning hole 202*b* and the positioning portion 305*a* form second fitting sections that are provided at positions, which face each other, on the carriage 200 and the cutter unit 300. Moreover, the recessed positioning hole 202*b* forms a carriage-side recessed portion, and the protruding positioning portion 305*a* forms a cutter unit-side protruding portion. Accordingly, the joining of the first fitting sections starts before the joining of the second fitting sections. More specifically, after the loose fitting of the shaft 208 to the input portion 310*a* starts, the fitting of the output portion (protruding transmission portion) 209*a* to the input portion (recessed transmission portion) 310*a* starts and the fitting of the shaft 208 to the positioning hole 305*g* then starts. Further, the fitting of the positioning portion 305*a* to the positioning hole 202*b* starts as in FIG. 14 between the start of the loose fitting of the shaft 208 to the input portion 310*a* and the start of the fitting of the output portion 209*a* to the input portion 310*a*. Since the timings of the start of the fitting of the respective portions to be fitted are shifted from each other in this way, the workability of the attaching of the cutter unit 300 can be improved.

The tip portion 208*a* of the shaft 208 has a sufficient length, and the length of the tip portion 208*a* is a length that allows the cutter unit 300 not to fall from the carriage 200 even though a user gets one's hand off the cutter unit 300 after the cutter unit 300 is positioned as in FIG. 15. For example, the length of the tip portion 208*a* is set so that the tip (the left end in FIG. 15) of the tip portion 208*a* is positioned on the left side of the centroid of the cutter unit 300 in FIG. 15 when the cutter unit 300 is positioned relative to the carriage 200 as in FIG. 15. Since the falling of the cutter unit 300 caused by gravity is prevented as described above, a user gets one's hand off the cutter unit 300 and can fix the cutter unit 300 by the fixing screw 313 after positioning the cutter unit 300 as in FIG. 15. As a result, the workability of the mounting of the cutter unit 300 is improved.

When the cutter unit 300 is not present at a correct position during the work for mounting the cutter unit 300, there is a concern that the tip portion 208*a* of the shaft 208 may come into contact with the upper and lower rotary blades 301 and 302. That is, when the tip portion 208*a* faces the rotary blades 301 and 302 at the time of the attaching of the cutter unit 300, there is a concern that the tip portion 208*a* may come into contact with the rotary blades 301 and 302. Accordingly, the guide rail 101 is provided with an abutment portion 101*g* (see FIG. 7) in this embodiment. The abutment portion 101*g* comes into contact with the positioning portion 305*a* of the cutter unit 300 so as to prevent the tip portion 208*a* from coming into contact with the upper and lower rotary blades 301 and 302 before the tip portion 208*a* comes into contact with the rotary blades 301 and 302. A position where a portion such as the abutment portion 101*g* coming into contact with the positioning portion 305*a* is provided is not limited to the guide rail 101, and the portion such as the abutment portion 101*g* may be provided on a component of the carriage 200 or a component other than the cutting apparatus 5. The positioning portion 305*a* and the abutment portion 101*g* form a pair of opposite portions that can come into contact with each other when the tip portion 208*a* faces the rotary blades 301 and 302 at the time of the attaching of the cutter unit 300.

Handhold parts 305*b* (see FIG. 9) are provided on both side surfaces of the main holder 305 so that a user stably holds the cutter unit 300 with hands at the time of the attachment and detachment of the cutter unit 300. As in FIG. 9, the handhold parts 305*b*, the input portion 310*a*, the positioning portion 305*a*, and the fixing screw 313 are disposed on substantially the same straight line in the directions of the arrows X1 and X2. Accordingly, the holding property and operability of the cutter unit 300 at the time of the attachment and detachment of the cutter unit 300 can be ensured. Further, when the cutter unit 300 is formed in a shape in which a portion of the cutter unit 300 other than the handhold parts 305*b* has a small area so as not to be easily held, a user can easily recognize the handhold parts 305*b* as handles even when attaching and detaching the cutter unit 300 for the first time.

(Outer Shape of Cutter Unit)

As in FIGS. 11 and 12, the main holder 305 includes a support portion 305*c*1, a support portion 305*c*2, a push-out portion 305*d*, and a guide portion 305*e*, and the upper holder 306 includes a guide portion 306*a*. When a sheet 1 having a short cutting length is cut by the cutter unit 300, the behavior of the cut sheet is unstable. For this reason, there is a concern that the sheet may enter the guide rail 101. In this state, when the cutter unit 300 having completely performed a cutting operation moves in the direction X2, there is a concern that a malfunction may be caused by the contact between the cutter unit 300 and the sheet having entered the guide rail 101. Accordingly, in this embodiment, the back of the cut sheet is supported by the support portions 305*c*1 and 305*c*2. That is, the support portion 305*c*1 extends toward the upstream side in the cutting direction (the direction of the arrow X1) from the vicinity of the cutting point (cutting portion) 309 (see FIG. 9) between the upper and lower rotary blades 301 and 302, and is positioned on the downstream side in the conveying direction of a sheet 1. The support portion 305*c*2 extends toward the downstream side in the cutting direction from the vicinity of the cutting point 309, and is positioned on the downstream side in the conveying direction of the sheet 1. Accordingly, when the sheet 1 is cut, a portion, which is not yet cut, of the sheet 1 is supported by the support portion 305*c*1 and the cut portion of the sheet 1 is supported by the support portion 305*c*2. As a result, the sheet 1 can be cut in a stable posture and the cut sheet can be reliably discharged.

Further, in a case in which a rear end of the cut sheet enters the cutting point 309 between the upper and lower rotary blades 301 and 302 when the cutter unit 300 returns in the direction of the arrow X2 after the cutting of the sheet 1, there is a concern that the rear end of the cut sheet 1 may be cut again. Accordingly, the rear end of the cut sheet 1 is pushed out by the push-out portion 305*d* in this embodiment. That is, since the push-out portion 305*d* protrudes toward the downstream side of the cutting point 309 in the conveying direction of the sheet 1, the push-out portion 305*d* pushes out the cut sheet to the downstream side in the conveying direction when the cutter unit 300 returns in the direction of the arrow X2. Accordingly, it is possible to prevent the rear end portion of the cut sheet from being cut again.

Further, in a case in which an end portion of the remaining sheet 1 without being cut off comes into contact with the main holder 305 and the upper holder 306 when the cutter unit 300 returns in the direction of the arrow X2 after the cutting of the sheet 1, there is a concern that a printed surface of the remaining sheet 1 on which images have been printed may be damaged. Accordingly, the guide portion 305*e* and the guide portion 306*a* have been provided in this embodiment. These guide portions 305*e* and 306*a* are positioned on a side, which faces the printed surface of the sheet 1 on which images have been printed, and on the upstream side in the conveying direction; and are formed in a tapered shape that is inclined upward toward the upstream side in the conveying direction. These guide portions 305*e* and 306*a* guide the end portion of the remaining sheet 1 when the cutter unit 300 returns in the direction of the arrow X2. Accordingly, since the contact between the end portion of the sheet 1 and the holders 305, 306 is avoided or a contact region is limited to only the tip portion of the end portion of the sheet 1, damage to the printed surface can be suppressed.

(Replacement of Cutter Unit)

Figure 16:
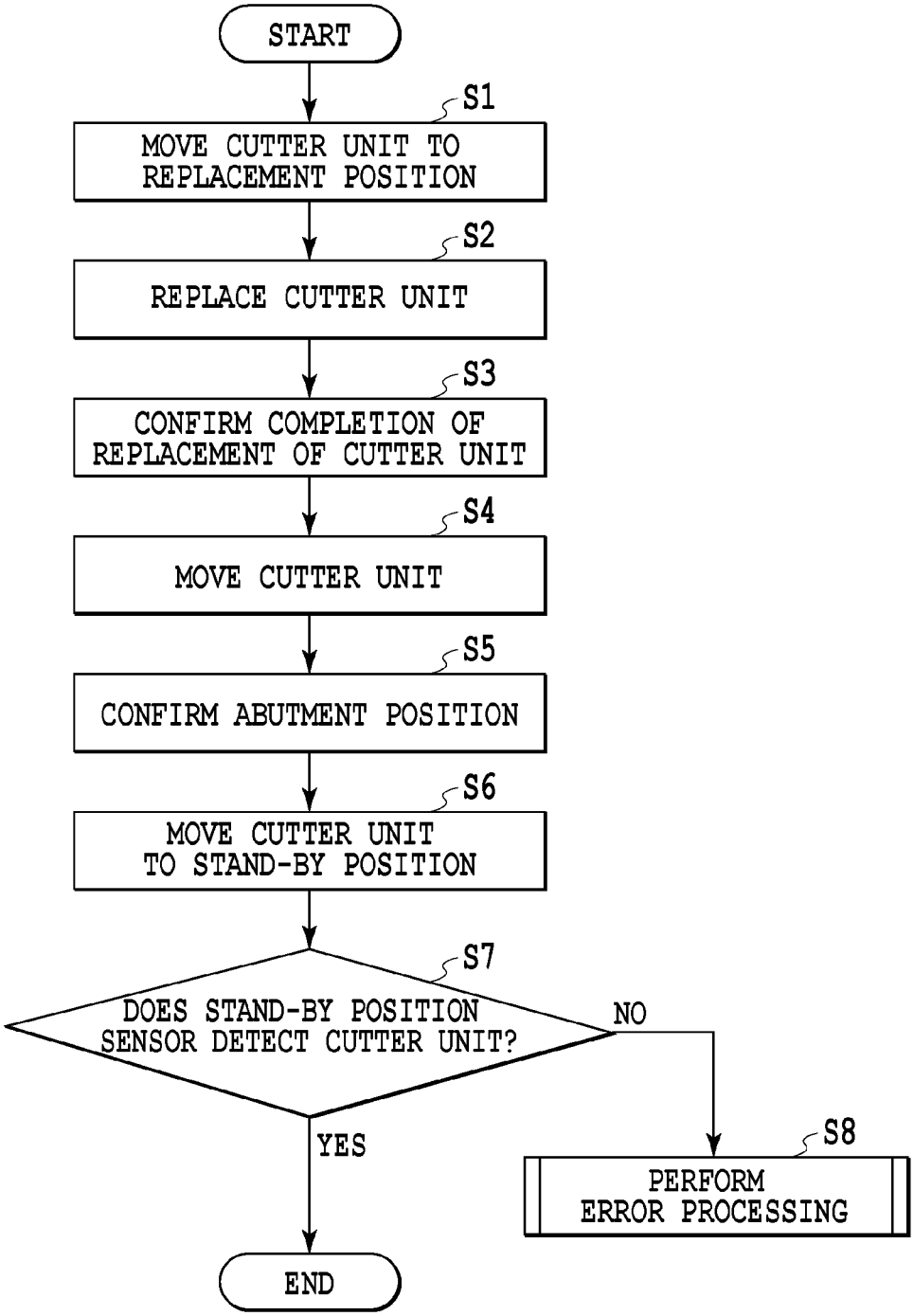
FIG. 16 is a flowchart illustrating an operation at the time of the replacement of the cutter unit.

FIG. 16 is a flowchart illustrating an operation at the time of the replacement of the cutter unit 300.

First, when a replacement mode of the cutter unit 300 is selected on an operation unit (not illustrated) of the printing apparatus 100, the cutter unit 300 is moved to a predetermined replacement position together with the carriage 200 (Step S1). The replacement position is a position at which a user easily replaces the cutter unit 300, and is set at, for example, a substantially middle position or the like of a region in which the cutter unit 300 moves in the directions of the arrows X1 and X2. Next, the cutter unit 300 is detached through the separation of the fixing screw 313, and a new cutter unit 300 is fixed instead of the cutter unit 300 by the fixing screw 313 after being positioned on the carriage 200 as described above (Step S2). When the completion of the replacement of the cutter unit 300 from the operation unit of the printing apparatus 100 is input after the cutter unit 300 is replaced in this way, the completion of the replacement of the cutter unit 300 is confirmed (Step S3). After that, the carriage 200 is moved in the direction of the arrow X1 (Step S4) so that a part of the carriage 200 abuts on a stopper (not illustrated) of the cutter motor 103 side. The abutment position of the carriage 200 is confirmed by the detection of the change of the load of the cutter motor 103 (Step S5).

Since it is difficult for jumping of the teeth of the belt 102 to occur at the time of the abutment, the abutment position can be accurately recognized by the reliable detection of the change of the load of the cutter motor 103. Both end portions of the belt 102, that is, one end portion of the belt 102 corresponding to the motor pulley 107 and the other end portion of the belt 102 corresponding to the tensioner pulley 108 are connected to the belt insertion portion 202*a* of the carriage holder 202, as described above. The length of a portion of the belt 102, which is positioned between one end portion of the belt 102 and the motor pulley 107, is relatively short. Since a portion of the belt 102, which is positioned between the other end portion of the belt 102 and the motor pulley 107, is turned back through the tensioner pulley 108, the length of the portion of the belt 102 is relatively long. When the carriage 200 is moved in the direction of the arrow X1 to allow the carriage 200 to abut the stopper, the former short portion of the belt 102 pulls the cutter unit 300. Accordingly, the amount of elongation of the former short portion of the belt 102 is small and it is difficult for jumping of the teeth between the belt 102 and the motor pulley 107 to occur. If the carriage 200 is moved in the direction of the arrow X2 to abut a stopper (not illustrated) of the tensioner pulley 108 side, the latter long portion of the belt 102 pulls the cutter unit 300. For this reason, the amount of elongation of the latter long portion of the belt 102 is large and jumping of the teeth is likely to occur between the belt 102 and the motor pulley 107.

After the abutment position is confirmed in Step S5, the carriage 200 is moved in the direction of the arrow X2 on the basis of the abutment position by position control based on the output signals (pulse signals) of the encoder 104 and is positioned at the stand-by position P1 (Step S6). Then, it is determined whether or not the sensor flag part 305*f* of the cutter unit 300 is detected by the stand-by position sensor 106 provided at the stand-by position P1 (Step S7). If the sensor flag part 305*f* is detected, it is determined that the cutter unit 300 is correctly replaced and a series of processing ends. On the other hand, if the sensor flag part 305*f* is not detected, it is determined that the cutter unit 300 is not normally mounted or the movement of the carriage 200 is not normal and error processing, such as notifying a user of the contents of the determination, is performed (Step S8).

(Structure of Unit)

Since each of the carriage 200 and the cutter unit 300 of the cutting apparatus 5 is unitized, the carriage 200 and the cutter unit 300 can be attached to each other and detached from each other. Since the rotary blades 301 and 302 are provided in the unitized cutter unit 300, the cutter unit 300 has only to be replaced when the rotary blades 301 and 302 need to be replaced due to the abrasion or the like of the rotary blades 301 and 302. If the rotary blades 301 and 302 are assembled in the cutting apparatus 5 while the carriage 200 and the cutter unit 300 are not unitized, the cutting apparatus 5 should be disassembled for the replacement of the rotary blades 301 and 302, therefore the replacement of the rotary blades 301 and 302 is very troublesome. Particularly, when the cutting apparatus 5 is assembled to an apparatus, such as the printing apparatus 100, the replacement of the rotary blades 301 and 302 is very troublesome.

As described above, the output portion 209*a* of the carriage 200, which output torque, and the input portion 310*a* of the cutter unit 300 to which the torque is input have both a function to transmit torque to the lower rotary blade 302 and a function to position the cutter unit 300. Accordingly, the size of the carriage 200 and the size of the cutter unit 300 can be reduced. Particularly, since it is easy to handle the cutter unit 300 by the reduction of the size of the cutter unit 300, workability at the time of the replacement of the cutter unit 300 is significantly improved.

(Other Embodiments)

The structure of blades of a cutting apparatus for cutting a sheet is not limited to the structure that uses two rotary blades, and the cutting apparatus has only to be capable of cutting a sheet with the relative movement of itself and the sheet. For example, the cutting apparatus may use a movable blade that moves up and down, a stationary blade, and a combination of a movable blade and a stationary blade, and the number of blades may be one. Further, the cutting apparatus may be assembled to various apparatuses that handle sheets other than the printing apparatus.

The guide mechanism, which guides the carriage 200 to allow the carriage 200 to be movable in the guide rail 101, includes the rotatable rollers 205A and 205B as guide members that are in contact with the guide surfaces of the guide rail 101. The guide members may be members that slide without rotating while being in contact with the guide surfaces of the guide rail 101. In this case, at least two surfaces to be guided, which are in contact with the guide rail 101, can be formed on each guide member as in the case of each of the rotatable rollers 205A and 205B, and the number of the guide members to be disposed may be one or more. Further, this guide mechanism can be widely applied as a guide mechanism that guides various carriages to allow the carriages to be movable. For example, the guide mechanism can be applied as a guide mechanism for the carriage 3 on which the printing head 2 is mounted, a carriage on which a head for reading an image is mounted, or the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2015-190049 filed Sep. 28, 2015, No. 2015-190118 filed Sep. 28, 2015, and No. 2015-190175 filed Sep. 28, 2015, which are hereby incorporated by reference in their entirety.

What is claimed is:

1. A cutting apparatus comprising:

a conveying unit configured to convey a sheet in a conveying direction;

a carriage configured to move in a crossing direction, the crossing direction crossing the conveying direction;

a cutter unit including a rotary blade for cutting the sheet and configured to be attachable to the carriage;

a rotary portion provided on the carriage and configured to rotate with movement of the carriage;

a shaft provided coaxially with the rotary portion;

a driving input portion provided on the cutter unit and configured to transmit rotation of the rotary portion to the rotary blade, in a case when the shaft is inserted into the driving input portion;

an input gear provided coaxially with the driving input portion and configured to rotate with the driving input portion; and a pendulum gear provided on the cutter unit, wherein the pendulum gear transmits the rotation of the rotary portion to the rotary blade in a case when the cutter unit moves in a first direction along the crossing direction, and does not transmit the rotation of the rotary portion to the rotary blade in a case when the cutter unit moves in a second direction which is opposed to the first direction.

2. The cutting apparatus according to claim 1, wherein the carriage is provided with an abutment portion and the cutter unit is provided with a positioning portion, the abutment portion and the positioning portion being located to come into contact with each other in a case when the shaft and the rotary blade face each other and the cutter unit is attached to the carriage, wherein the contact between the abutment portion and the positioning portion prevents the shaft and the blade from coming into contact with each other.

3. The cutting apparatus according to claim 2, further comprising:

a rotation preventing unit including a rotation preventing protruding portion provided on the cutter unit and a rotation preventing recessed portion provided on the carriage, wherein the rotation preventing protruding portion fits within the rotation preventing recessed portion when the cutter unit is attached to the carriage, and wherein one of the pair of opposite portions is the rotation preventing protruding portion.

4. The cutting apparatus according to claim 1, further comprising a positioning hole provided coaxially with the driving input portion and configured to fit to the shaft, wherein the rotary portion has a protruding transmission portion, the driving input portion has a recessed transmission portion to which the protruding transmission portion is fitted, and the protruding transmission portion is positioned on an outside of the shaft.

5. The cutting apparatus according to claim 4, wherein the protruding transmission portion includes an outer peripheral portion having a polygonal cross section, and the recessed transmission portion includes an inner peripheral portion having a polygonal cross section, the inner peripheral portion and the outer peripheral portion being fitted to each other.

6. The cutting apparatus according to claim 4, wherein a tip of the protruding transmission portion has a tapered shape.

7. The cutting apparatus according to claim 4, wherein the shaft protrudes from a tip of the protruding transmission portion, the recessed transmission portion is positioned outside the positioning hole, and the shaft and the positioning hole are configured such that a gap is formed between the shaft and a surface of the positioning hole if the cutter unit is detached from the carriage.

8. The cutting apparatus according to claim 7, wherein the shaft and driving input portion have the same color, and the color is different from colors of other peripheral portions.

9. The cutting apparatus according to claim 1, further comprising:

a positioning hole provided coaxially with the driving input portion and configured to fit to the shaft, a rotation preventing unit including (i) a rotation preventing protruding portion provided on one of the carriage and the cutter unit and (ii) a rotation preventing recessed portion that is provided on the other thereof, wherein the rotation preventing protruding portion fits within the rotation preventing recessed portion when the cutter unit is attached to the carriage.

10. The cutting apparatus according to claim 1, further comprising:

a belt configured to transmit a driving force of a driving source to the carriage to move the carriage in the crossing direction.

11. The cutting apparatus according to claim 1, wherein the shaft is configured to be inserted into the driving input portion in an insertion direction as the cutter unit is attached to the carriage, and the driving input portion is movable in a direction crossing the insertion direction when the cutter unit is in a state before the shaft is inserted into the driving input portion.

12. A printing apparatus comprising:

a printing unit configured to print an image on a sheet; and a cutting apparatus according to claim 8 that cuts the sheet used in the printing unit.

13. A cutting apparatus comprising:

a conveying unit configured to convey a sheet in a conveying direction;

a carriage configured to move in a crossing direction, the crossing direction crossing the conveying direction;

a cutter unit including a rotary blade for cutting the sheet and configured to be attachable to the carriage;

a rotary portion provided on the carriage and configured to rotate with movement of the carriage;

a shaft provided coaxially with the rotary portion;

a driving input portion provided on the cutter unit and configured to transmit rotation of the rotary portion to the rotary blade, in a case when the shaft is inserted into the driving input portion;

an input gear provided coaxially with the driving input portion and configured to rotate with the driving input portion;

a positioning hole provided coaxially with the driving input portion and configured to fit to the shaft and a rotation preventing unit including (i) a rotation preventing protruding portion provided on one of the carriage and the cutter unit and (ii) a rotation preventing recessed portion that is provided on the other thereof;

wherein, the rotation preventing unit, the rotary portion, the driving input portion, the shaft, and the hole are configured such that, while the cutter unit is being attached to the carriage, the rotation preventing protruding portion fits within the rotation preventing recessed portion at a timing that differs from (i) when the rotary portion connects to the driving input portion and (ii) when the shaft fits within the positioning hole.

* * * * *